US009201355B2

(12) United States Patent
Tanaka

(10) Patent No.: US 9,201,355 B2
(45) Date of Patent: Dec. 1, 2015

(54) IMAGE HEATING APPARATUS

(71) Applicant: CANON KABUSHIKI KAISHA, Tokyo (JP)

(72) Inventor: Masanobu Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/159,686

(22) Filed: Jan. 21, 2014

(65) Prior Publication Data

US 2014/0205307 A1 Jul. 24, 2014

(30) Foreign Application Priority Data

Jan. 21, 2013 (JP) ..... 2013-008243

(51) Int. Cl.
*G03G 15/20* (2006.01)
*G03G 21/20* (2006.01)

(52) U.S. Cl.
CPC ..... *G03G 15/2017* (2013.01); *G03G 15/2042* (2013.01); *G03G 21/206* (2013.01); *G03G 2215/2022* (2013.01)

(58) Field of Classification Search
CPC ..... G03G 15/2042; G03G 15/2082
USPC ..... 399/43
See application file for complete search history.

(56) References Cited

U.S. PATENT DOCUMENTS

| | | | | |
|---|---|---|---|---|
| 7,650,105 | B2 | 1/2010 | Ogawa et al. | |
| 8,364,067 | B2 | 1/2013 | Miki et al. | |
| 8,532,530 | B2 | 9/2013 | Nishida et al. | |
| 8,655,213 | B2 | 2/2014 | Tanaka et al. | |
| 8,666,273 | B2 | 3/2014 | Tanaka | |
| 2006/0088326 | A1* | 4/2006 | Nakayama | 399/69 |
| 2007/0189798 | A1* | 8/2007 | Matsuno | 399/92 |
| 2009/0274497 | A1* | 11/2009 | Okamoto et al. | 399/325 |
| 2010/0008691 | A1* | 1/2010 | Fujiwara | 399/69 |
| 2011/0229200 | A1* | 9/2011 | Yamaguchi et al. | 399/122 |
| 2011/0280603 | A1* | 11/2011 | Takahashi et al. | 399/45 |
| 2012/0148290 | A1* | 6/2012 | Asami | 399/92 |
| 2012/0155938 | A1 | 6/2012 | Tanaka et al. | |
| 2012/0275813 | A1* | 11/2012 | Matsumoto | 399/92 |

(Continued)

FOREIGN PATENT DOCUMENTS

| | | | |
|---|---|---|---|
| JP | 2002-244464 | A | 8/2002 |
| JP | 2008-003141 | A | 1/2008 |

OTHER PUBLICATIONS

U.S. Appl. No. 14/224,413, filed Mar. 25, 2014, to Akatsuka et al.

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

An image heating apparatus includes: an endless belt configured to heat an image on a sheet at a nip; a heating mechanism configured to heat the endless belt; a fan configured to send air toward a predetermined region of the endless belt; a heat pipe configured to move heat in a direction of uniformizing a temperature distribution of the endless belt with respect to a widthwise direction of the endless belt; and a controller configured to operate the fan such that the air flow rate is larger during heating of the image on a predetermined sheet providing an overlapping positional relationship with the predetermined region, than the air flow rate during the heating of the image on a sheet providing a non-overlapping positional relationship with the predetermined region.

7 Claims, 13 Drawing Sheets

(56) References Cited

U.S. PATENT DOCUMENTS

| | | | |
|---|---|---|---|
| 2012/0308279 | A1 | 12/2012 | Tanaka et al. |
| 2013/0129364 | A1 | 5/2013 | Kitagawa et al. |
| 2013/0206745 | A1 | 8/2013 | Tanaka et al. |
| 2013/0272762 | A1 | 10/2013 | Uekawa et al. |
| 2013/0302046 | A1 | 11/2013 | Monde et al. |
| 2014/0105634 | A1 | 4/2014 | Tanaka et al. |

* cited by examiner

IMAGE HEATING APPARATUS

FIELD OF THE INVENTION AND RELATED ART

The present invention relates to an image heating apparatus for heating a toner image on a sheet.

In a conventional image forming apparatus of an electrophotographic type, the toner image is formed on recording paper (sheet) and fixed by application of heat and pressure in a fixing device (image heating apparatus).

Such a fixing device has been required to meet proper fixing with respect to recording papers, having various width sizes, from a maximum width size recording paper (large-sized paper) to a minimum width size recording paper (small-sized paper) which are usable in the fixing device. Here, with respect to the recording paper, the width (size) refers to a dimension with respect to a direction perpendicular to a recording paper feeding direction.

Particularly, in the case where the small-sized paper is continuously subjected to image heating, a phenomenon which is a so-called "non-sheet-passing portion temperature rise" can occur. That is, with respect to a heating member (e.g., a fixing roller) for heating the recording paper, at a sheet passing portion where the heating member contacts the small-sized paper, heat is taken by the recording paper, but at a non-sheet-passing portion where the heating member does not contact the small-sized paper, heat is gradually accumulated without being taken by the recording paper. Accordingly, at the non-sheet-passing portion, the heating member is required to suppress the occurrence of excessive temperature rise.

Therefore, as a measure against the non-sheet-passing portion temperature rise, in a fixing device described in Japanese Laid-Open Patent Application (JP-A) 2008-3141, the non-sheet-passing portion temperature rise is intended to be suppressed by changing an opening region of a shutter depending on the width size of the recording paper and then by blowing (sending) air from a fan to only the non-sheet-passing portion.

Further, in a fixing device described in JP-A 2002-244464, locally excessive temperature rise of a fixing roller is intended to be suppressed by providing a high heat conduction member (heat pipe) inside the fixing roller.

However, in the case of a method described in JP-A 2008-3141, a mechanism for changing, depending on the width size of the recording paper, a cooling range by the fan is needed, but the fixing device then becomes inevitably complicated. Further, it is difficult in reality to address all of the width sizes of the recording papers.

Further, in the case of a method described in JP-A 2002-244464, the high heat conduction member is only used and therefore it is difficult to address the conspicuous non-sheet-passing portion temperature rise phenomenon with the speeding-up of fixing in recent years.

SUMMARY OF THE INVENTION

According to an aspect of the present invention, there is provided an image heating apparatus comprising: an endless belt configured to heat an image on a sheet at a nip; a heating mechanism configured to heat the endless belt; a fan configured to send air toward a predetermined region of the endless belt; a heat pipe configured to move heat in a direction of uniformizing a temperature distribution of the endless belt with respect to a widthwise direction of the endless belt; and a controller configured to operate the fan such that an air flow rate is larger during heating of the image on a predetermined sheet providing an overlapping positional relationship with the predetermined region, than an air flow rate during the heating of the image on a sheet providing a non-overlapping positional relationship with the predetermined region.

According to another aspect of the present invention, there is provided an image heating apparatus comprising: an endless belt configured to heat an image on a sheet at a nip; a heating mechanism configured to heat the endless belt; a first fan configured to send air toward a first region in one side with respect to a widthwise direction of the endless belt; a second fan configured to send air toward a region in the other side with respect to the widthwise direction of the endless belt; a heat pipe configured to move heat in a direction of uniformizing a temperature distribution of the endless belt with respect to the widthwise direction of the endless belt; and a controller configured to operate the first fan and the second fan when the endless belt is cooled during heating of the image on a predetermined sheet providing an overlapping positional relationship between the first and second regions and a contact region of the predetermined sheet with the endless belt.

According to a further aspect of the present invention, there is provided an image heating apparatus comprising: an endless belt configured to heat an image on a sheet at a nip; a heating mechanism configured to heat the endless belt; a fan configured to send air toward a region outside, with respect to a widthwise direction of the endless belt, a region of the endless belt contacting a maximum width sheet usable in the image heating apparatus; a heat pipe configured to move heat in a direction of uniformizing a temperature distribution of the endless belt with respect to the widthwise direction of the endless belt; and a controller configured to control a rotational speed of the fan depending on a width size of the sheet when the endless belt is cooled during heating of the image on the sheet.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described below with reference to the drawings.

Embodiment 1

Image Forming Apparatus

Figure 1:
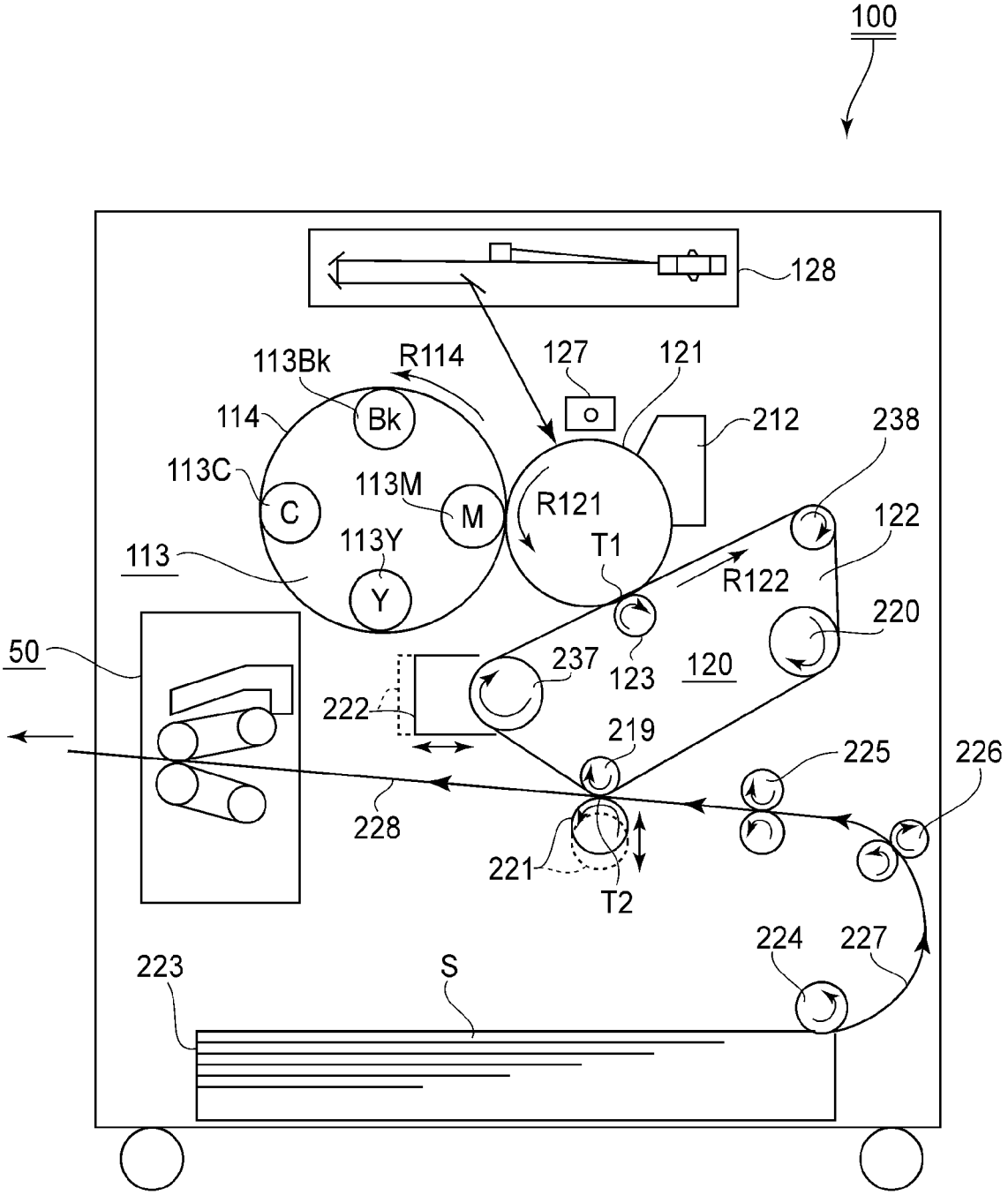
FIG. 1 is a schematic illustration of an image forming apparatus (electrophotographic color printer) in Embodiment 1.

FIG. 1 is an illustration of a structure of an example of an image forming apparatus 100 in which a fixing device 50 functioning as an image heating apparatus according to the present invention is mounted. The image forming apparatus 10 is an electrophotographic color printer and includes an electrophotographic photosensitive drum 121 as an image bearing member on which a latent image is to be formed. The drum 121 is rotationally driven in the counterclockwise direction of an arrow R121 at a predetermined peripheral speed. At a periphery of the drum 121, a primary charger 127, a laser scanner 128, a rotary developing device 113, an intermediary transfer belt unit 120 and a cleaning device 212 are provided.

The rotary developing device 113 includes a rotary device 114 subjected to intermittent rotation control at a predetermined assigned angle with respect to the counterclockwise direction of an arrow R114 and includes a plurality of developing portions provided along a circumference of the rotary 114. In this embodiment, four developing portions consisting of the developing portion accommodating a toner (developer) of magenta (M), the developing portion accommodating a toner of yellow (Y), the developing portion accommodating a toner of cyan (C) and the developing portion accommodating a toner of black (Bk) are disposed in a 90-degree assignment manner. The developing portions include developing rollers 113M, 113Y, 113C and 113Bk.

By rotation angle control of the rotary device 114, the developing rollers 113M, 113Y, 113C and 113Bk of the developing portions for the respective colors are successively moved in a switching manner to a position (developing portion) where the developing roller contacts or closely opposes the drum 121.

The intermediary transfer belt unit 120 includes an endless belt 122 extended and stretched by a plurality of parallel rollers 219, 220, 237 and 238. The belt 122 is urged against the drum 121 by a primary transfer roller 123 provided between the rollers 237 and 238. A contact portion between the drum 121 and the belt 122 is a primary transfer nip T1. The belt 122 is rotationally driven in the clockwise direction of an arrow R122 at a peripheral speed corresponding to the peripheral speed of the drum 121.

At a portion where the roller 219 contacts the belt 122, a secondary transfer roller 221 is provided. The roller 221 is moved, by a shifting means (not shown), to a first position in which the roller 221 contacts the belt 122 as indicated by a solid line and a second position in which the roller 221 is spaced from the belt 122 as indicated by a broken line. At a portion where the roller 237 contacts the belt 122, a belt cleaning device 222 is provided. The cleaning device 222 is moved, by a shifting means (not shown), to a first position in which the device 222 acts on the belt 122 as indicated by a solid line and a second position in which the device 122 is spaced from the belt 122 as indicated by a broken line.

A color image forming operation is as follows. The drum 121 is rotationally driven. Also the belt 122 and the belt cleaning device 222 are moved to the second position.

In the above state, the surface of the drum 121 is electrically charged uniformly to predetermined polarity and potential by the primary charger 127. The drum surface is subjected to main scanning exposure, by a scanner 128, with a laser beam modulated by an image signal. By this main scanning exposure and sub-scanning by drum rotation, an electrostatic latent image corresponding to an exposure pattern is formed on the drum surface. The electrostatic latent image is developed as a toner image by the developing device 113. The toner image is transferred onto the surface of the belt 122. The drum surface passed through the nip T1 is cleaned by the cleaning device 212 and then is repeatedly subjected to image formation.

A series of image forming steps of the charging, the exposure, the development, the primary transfer and the cleaning is repetitively executed with respect to each of separated colors of M, Y, C and Bk for the respective color toner images. As a result, an unfixed four-color based, full-color toner image, consisting of superposed color toner images of M, Y, C and Bk, is formed on the surface of the belt 122.

Then, at a predetermined control timing somewhat before a leading end portion of the full-color toner image on the belt 122 reaches the roller 219, each of the secondary transfer roller 221 and the belt cleaning device 222 is moved to the first position. By the contact of the roller 221 with the belt 122, a secondary transfer nip T2 is formed.

Further, at a predetermined control timing, the feeding roller 224 is driven. As a result, sheets of a recording material (recording paper) S, such as plain paper, resin-coated paper, an OHP sheet, an envelope, or a postcard, stacked and accommodated in a feeding cassette 223 provided at a lower portion of the image forming apparatus 100, are separated and fed one by one. The recording paper S is introduced into a feeding path 227 including a feeding roller pair 226 and a registration roller pair 225, and is placed in a stand-by state after oblique movement thereof is rectified by the registration roller pair 225.

The registration roller pair sends the recording paper S to the secondary transfer nip T2 is synchronism with timing of the toner image on the belt 122. The recording paper S is successively subjected to collective secondary transfer of the superposed four color toner images from the belt 122 in a process in which the recording paper S is nipped and fed through the nip T2. The recording paper S passed through the nip T2 is separated from the belt 122 to pass through a feeding path 228, and then is introduced into a fixing device 50, in which the unfixed toner image is heated and pressed, thus being thermally fixed as a fixed image on the recording paper S. Then, the recording paper S comes out of the fixing device 50 and then is discharged, as a full-color image-formed product, to an outside of the image forming apparatus.

The surface of the belt 122 after the recording paper S is separated therefrom is cleaned by the belt cleaning device 222. Each of the roller 221 and the device 222 is moved back to the second position at a predetermined control timing after a rear end portion of the recording paper S passed through the nip T2. The recording paper S is fed from the feeding cassette 223 as described above or is fed into the image forming apparatus through an unshown feeding tray.

In the above-described image forming apparatus 100, an image forming mechanism portion until the recording paper S reaches the fixing device 50 is the image forming portion for forming the unfixed image on the recording paper S.

<Fixing Device>

Figure 2:
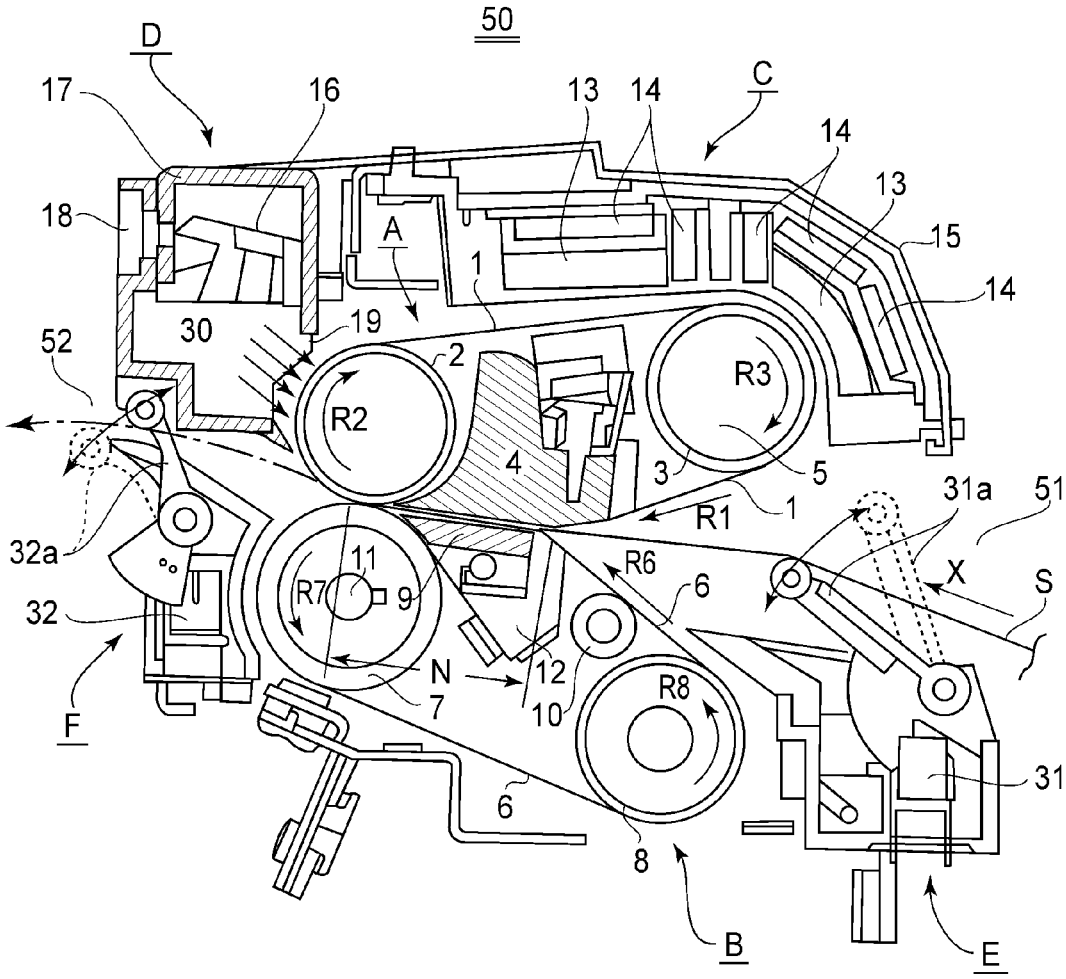
FIG. 2 is a schematic illustration of a fixing device (image heating apparatus).

FIG. 2 is a schematic cross-sectional left side view of a principal portion for illustrating a structure of the fixing device 50 in this embodiment.

Here, in the following description, with respect to the fixing device 50 functioning as the image heating apparatus or members controlling the fixing device 50, a longitudinal direction (width direction) refers to a direction parallel to a direction perpendicular to a recording paper feeding direction X at a nip of the fixing device 50 or an axial direction of the rotatable member. As described later, this direction is also called a width direction of the fixing device. A short direction refers to a direction parallel to the recording paper feeding direction X or a direction perpendicular to a rotational axis direction of the rotatable member. This direction is also called a movement direction (circumferential direction) of the fixing belt.

Further, with respect to the fixing device 50, a front surface is a surface in a recording paper entrance portion 51 side, and a rear surface is a surface in a recording paper exit portion 52 side opposite from the recording paper entrance portion 51 side. Left and right are those of the fixing device 50 as seen from the front surface. Upper and lower are those with respect to a direction of gravitation. Upstream and downstream are those with respect to the recording paper feeding direction X. Further, a width of the recording paper S refers to a dimension of the recording paper S with respect to the direction perpendicular to the recording paper feeding direction X.

The fixing device 50 in this embodiment is the image heating apparatus of an electromagnetic belt heating type. The fixing device 50 roughly includes the following 6 units A to F, which are assembled with a fixing device casing (fixing device frame (not shown)) in a predetermined arrangement relationship.

1) Heating belt unit A

2) Pressing belt unit B provided below the heating belt unit A

3) Coil unit (magnetic flux generating means) C provided above the heating belt unit A 4) Fan cooling unit (fan cooling means) D provided in a downstream of the heating belt unit A with respect to the recording paper feeding direction 5) Entrance-side sensor unit E provided upstream of the pressing belt unit B with respect to the recording paper feeding direction 6) Exit-side sensor unit F provided downstream of the pressing belt unit B with respect to the recording paper feeding direction These units will be described in the listed order.

1) Heating Belt Unit A

This unit A includes a fixing belt 1 which is an endless belt as a rotatable heating member for heating the unfixed toner image on the recording paper S. The fixing belt 1 is extended and stretched around a fixing roller 2, a fixing tension roller 3 and a fixing pad 4. The fixing roller 2 and the fixing tension roller 3 are provided, with a spacing, downstream and upstream, respectively, with respect to the recording paper feeding direction. The fixing pad 4 is provided between the fixing roller 2 and the fixing tension roller 3 in a position close to the fixing roller 2 with a pad surface downward.

The fixing roller 2 is a driving roller and is rotationally driven, by a driving mechanism 21 (including a motor and a driving gear train) controlled by a control circuit portion 20 (FIG. 4), in the clockwise direction of an arrow R2 in FIG. 2 at a predetermined peripheral speed. By the rotational driving of this fixing roller 2, the fixing belt 1 is rotated in the clockwise direction of an arrow R1 based on a frictional force between the fixing belt 1 and the fixing roller 2. The fixing tension roller 3 is rotated in the clockwise direction of an arrow R3 by the rotation of the fixing belt 1.

Figure 3:
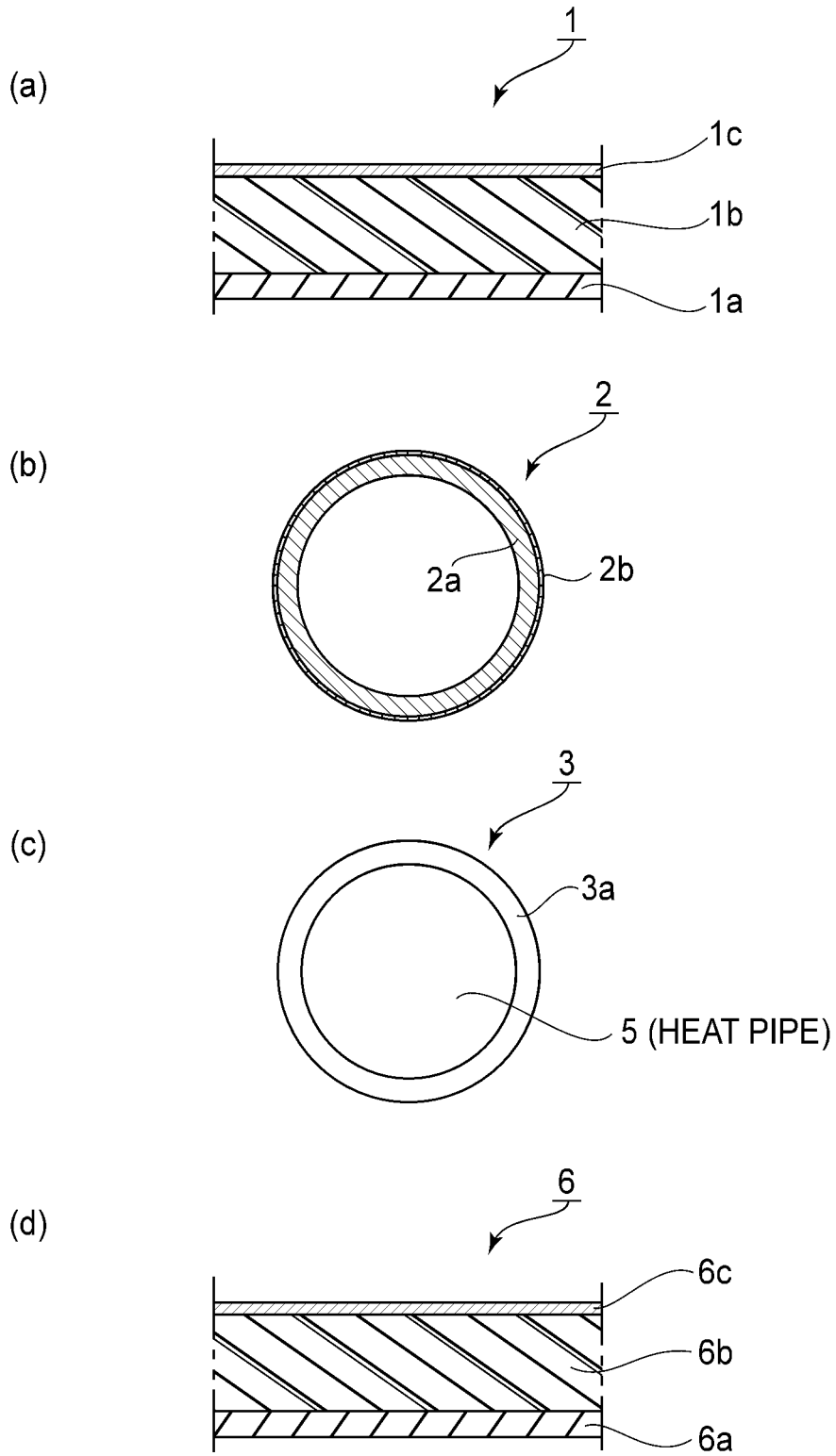
FIGS. 3(*a*)-3(*d*) are illustrations of constituent members of the fixing device.

FIG. 3(*a*) is an illustration showing a layer structure of the fixing belt 1. The fixing belt 1 is prepared by forming a 75 μm-thick base layer 1*a* of nickel and then by providing a 300 μm-thick elastic layer 1*b* on an outer peripheral surface of the base layer 1*a*. As a material for the elastic layer 1*b*, a silicone rubber is used and is 200 degrees in JIS-A hardness and 0.8 W/mK in thermal conductivity. On an outer peripheral surface of the elastic layer 1*b*, a 30 μm-thick layer of fluorine-containing resin (such as PFA or PTFE) as a surface parting layer 1*c* is provided. As the material for the elastic layer 1*b*, other than the silicone rubber, it is also possible to use a known elastic material such as fluorine-containing rubber.

FIG. 3(*b*) is an illustration showing a layer structure of the fixing roller 2. The fixing roller 2 is an elastic roller prepared by providing a silicone rubber layer 2*b* as an elastic layer on a surface of a 1 mm-thick metal core 2*a* of an iron-based alloy of 20 mm in outer diameter and 18 mm in inner diameter. The silicone rubber layer 2*b* is 15 degrees in JIS-A hardness and 0.8 W/mK in thermal conductivity.

FIG. 3(*c*) is an illustration showing a layer structure of the fixing tension roller 3. The fixing tension roller 3 is prepared by inserting a heat pipe 5, as a means for moving heat in a direction (width direction of the fixing belt 1) of alleviating a non-uniform (uniformizing) a temperature distribution of the fixing belt 1 with respect to the width direction, into a hollow roller 3*a* of iron having an outer diameter of 20 mm, an inner diameter of 18 mm and a thickness of 1 mm. The heat pipe 5 is fixed inside the hollow roller 3*a* in contact with the hollow roller 3*a*. A pipe material for the heat pipe 5 is copper and in the heat pipe 5, as a heating medium, pure water in a small amount is included.

The fixing tension roller 3 is assembled by being urged outward at end portions of a rotation shaft thereof by an unshown spring, thus applying tension to the fixing belt 1. Further, the fixing tension roller 3 is provided with the heat pipe 5 inside thereof, thus functioning as a heat-uniformizing member contacted to an inner peripheral portion of the fixing belt 1, so that the fixing tension roller 3 also performs the function of decreasing the difference in temperature distribution of the fixing belt 1 with respect to the longitudinal direction.

The fixing pad 4 performs the function of pressing the fixing belt 1 from the inside to cause the fixing belt 1 to press-contact a pressing belt 6. The fixing pad 4 is prepared by coating a slidable sheet on a surface of a metal core of a rigid member formed of a drawing material of SUS, so that the sliding resistance when the fixing pad 4 rubs with the inner surface of the fixing belt 1 is decreased. The slidable sheet is a sheet material prepared by coating a non-woven fabric of glass fiber with a fluorine-containing resin material.

2) Pressing Belt Unit B

This unit B is provided below the unit A and includes the pressing belt 6 as a rotatable pressing member (opposite member). The pressing belt is extended and stretched around a pressing roller 7, a pressing tension roller 8 and a pressing pad 9. The pressing roller 7 and the pressing tension roller 8 are provided, with a spacing, downstream and upstream, respectively, with respect to the recording paper feeding direction. The pressing pad 9 is provided between the pressing roller 7 and the pressing tension roller 8 in a position close to the pressing roller 7 with a pad surface upward.

Further, between the pressing roller 7 and the pressing tension roller 8, a lubricant application roller 10 for applying a lubricant onto an inner surface of the pressing belt 6 is provided.

FIG. 3(*d*) is an illustration showing a layer structure of the pressing belt 6. The pressing belt 6 is prepared by forming a 75 μm-thick base layer 6*a* of nickel and then by providing a 300 μm-thick elastic layer 6*b* on an outer peripheral surface of the base layer 6*a*. On a surface of the elastic layer 6*b* of the pressing belt 6, a 30 μm-thick layer of fluorine-containing resin (PFA) as parting layer 6*c* is provided.

The pressing roller 7 is a hollow roller of an iron-based alloy having an outer diameter of 23 mm, an inner diameter of 20 mm and a thickness of 1.5 mm, and a halogen heater 11 is provided along a center axis of the pressing roller 7. The heater 11 is supplied with electric power from an electric power (energy) supplying circuit 22 controlled by the control circuit portion 20, thus generating heat to internally heat the pressing roller 7. The temperature of the pressing roller 7 is detected by a temperature sensor TH7, such as a thermistor, and then is fed back to the control circuit portion 20. The control circuit portion 20 controls, on the basis of temperature information inputted from the sensor TH7, electric power to be supplied from the electric power supplying circuit 22 to the heater 11 so that the surface temperature of the pressing roller 7 is maintained (temperature-controlled) at a predetermined control temperature.

Further, the pressing roller 7 is rotationally driven outside the heater 11 in the counterclockwise direction of an arrow R7 in FIG. 2 at a predetermined peripheral speed. By the rotational drive of the pressing roller 7, the pressing belt 6 is rotated in the counterclockwise direction of an arrow R6. The pressing tension roller 8 is rotated in the counterclockwise direction of an arrow R8 by the rotation of the pressing belt 6.

The pressing tension roller 8 is an iron-based alloy-made hollow roller f 20 mm in outer diameter, 16 mm in inner diameter and 2 mm in thickness. The pressing tension roller 8 is assembled by being urged at end portions of a rotation shaft thereof by an unshown spring, thus applying tension to the pressing belt 6.

The pressing pad 9 is an elastic member and is supported by a rigid cross-member 12 to form a predetermined rotation path of the pressing belt 6, thus urging the pressing belt 6 toward the fixing belt 1. The pressing pad 9 can be constituted by the silicone rubber or the fluorine-containing rubber, and in this embodiment, the silicone rubber of 15 degrees in JIS-A hardness was used. The pressing cross-member 12 not only supports the pressing pad 9 but also performs the function of a guide for defining a bent position of the pressing belt 6.

The unit B is movable, by a pressing and spacing mechanism 23 (e.g., a mechanism using a motor and a cam or a mechanism using an electromagnetic solenoid) controlled by the control circuit portion 20, a pressing position against the unit A and a spaced position in non-contact with the unit A. The control circuit portion 20 causes the pressing and spacing mechanism 23 to perform a pressing operation during passing of the recording paper S through the fixing device 50. As a result, the unit B is raised relative to the unit A to be moved and held at the pressing position where the unit B is press-contacted to the unit A at a predetermined urging force. FIG. 2 shows a state in which the unit B is moved to the pressing position and is held at the pressing position.

In this state, the pressing roller 7 is press-contacted to the pressing belt 6 toward the fixing roller 2 via the fixing belt 1 at a predetermined urging force. Further, the pressing pad 9 is press-contacted to the pressing belt 6 toward the fixing pad 4 via the fixing belt 1. As a result, between the fixing belt 1 of the unit A and the pressing belt 6 of the unit B, a nip (fixing nip) N which is wide with respect to the recording paper feeding direction X. In this embodiment, the width of the nip N is about 18 mm.

Each of the fixing roller 2 and the pressing roller 7 is rotationally driven at the predetermined peripheral speed by transmitting a driving force thereto from a driving mechanism 21. In this embodiment, a difference in peripheral speed is provided between the fixing roller 2 and the pressing roller 7, such that the peripheral speed of the pressing roller 7 is 103% of the peripheral speed (350 mm/sec) of the fixing roller 2.

By providing the fixing roller 2 with the silicone rubber layer 26, a friction transmitting force is generated between the fixing roller 2 and the inner surface of the fixing belt 1, and therefore the fixing belt 1 is satisfactorily rotated by the rotation of the fixing roller 2 as the driving roller. The fixing tension roller 3 is rotated by the rotation of the fixing belt 1.

The pressing pad 9 is supported by the pressing cross-member 12 and is contacted to the pressing belt 6, and urges the pressing belt 6 outward in a position of being projected from the pressing cross-member 12. In this embodiment, the amount of the projection is 1 mm. The surfaces of the pressing pad 9 and the pressing cross-member 12 are, similarly as in the fixing pad 4, coated with a slidable sheet, so that the friction resistance generated during sliding of the slidable sheet on the inner surface of the pressing belt 6 is decreased. Further, also by a lubricant applied onto the inner surface of the pressing belt 6 by the lubricant applying roller 10, a frictional resistance generated when the surfaces of the pressing pad 9 and the pressing cross-member 12 slide on the inner surface of the pressing belt 6 is decreased.

Further, the control circuit portion 20 functioning as a controller causes the pressing and spacing mechanism 23 to perform a spacing operation during stand-by for introduction of the recording paper into the fixing device 50. As a result, the unit B is lowered relative to the unit A from the pressing position to the spaced position spaced from the unit A by a predetermined distance and then is held in the spaced position. In this state, the formed nip N is eliminated, and each of the fixing roller 2 and the pressing roller 7 is independently driven rotationally. Accordingly, each of the fixing belt 1 and the pressing belt 6 is independently rotated in the spaced state.

3) Coil Unit C

This unit C is the magnetic flux generating means (IH heater) as the heating mechanism (heating means) for heating the fixing belt 1. The unit C is constituted by an exciting coil 13 for generating magnetic flux for heating the fixing belt 1 through electromagnetic heating, a magnetic core 14 for collecting the generated magnetic flux, a supporting portion 15 for supporting these members 13 and 14, and the like. The unit C is provided above the unit A, while being opposed to the unit A with a predetermined spacing, in non-contact with the fixing belt 1 in a region ranging from an upper surface portion of the fixing belt 1 to a portion where the fixing belt 1 is wound about the fixing tension roller 3.

In the coil 13, AC magnetic flux is generated by supplying an AC current to the coil 13 from an exciting circuit 24 controlled by the control circuit portion 20. The magnetic flux is introduced into a core 14 to generate an eddy current in the nickel base layer (magnetic metal layer or electro conductive layer) 1*a* of the fixing belt 1 as an induction heat generating member. The eddy current generates Joule heat by a specific resistance of the nickel base layer 1*a*. As a result, by the rotational driving of the fixing belt 1, the fixing belt 1 is heated and increased in temperature by electromagnetic heating through full circumference.

Then, the temperature of the fixing belt 1 is detected by a temperature sensor TH1 such as a thermistor and then is fed back to the control circuit portion 20. The control circuit portion 20 controls, the basis of temperature information inputted from the sensor TH1, electric power to be supplied from the exciting circuit 24 to the coil 13 so that a surface temperature of the fixing belt 1 is maintained (temperature-controlled) at a predetermined temperature.

4) Fan Cooling Unit D

This unit D is a means functioning as a non-sheet-passing portion temperature rise countermeasure for alleviating the non-sheet-passing portion temperature rise in the fixing device 50. That is, the unit D is the means for alleviating the non-sheet-passing portion temperature rise of the fixing device 50 by blowing (sending) air to a non-sheet-passing portion (region) of the fixing belt 1 in the case where sheets of a small-sized recording paper narrower in width than a maximum width recording paper (large-sized paper) capable of being used in (introduced into) the fixing device 50.

In this embodiment, this unit D is provided downstream of the unit A with respect to the recording paper feeding direction X, and includes a cooling fan 16 and a duct 17. The duct 17 is provided with a fan opening (air-blowing part) 19 in each of one end side (left side) and the other end side (right side) with respect to the longitudinal direction of the fixing belt 1. Each of these fan openings 19 faces a region where the fixing belt 1 is supported by the fixing roller 2.

The fan 16 is driven by a driving motor 37. The motor 37 is controlled by a driving circuit 36 controlled by the control circuit portion (controller) 20. By driving the fan 16, air is sucked in the duct 17 through an air intake 18 and then blows through the fan openings 19, so that a wind (current of air) 30 acts on the fixing belt 1 toward the fixing roller 2 in each of the one end side and the other end side with respect to the longitudinal direction of the fixing belt 1. Detailed description of fan control of the fan cooling unit D will be described later.

5) Entrance-Side Sensor Unit E

This unit E is provided upstream of the unit B with respect to the recording paper feeding direction X, and includes a sensor 31 for detecting the recording paper S entering the fixing device 50 through a recording paper inlet portion 51. A sensor arm (actuator) 31*a* of the sensor 31 is projected and erected as shown by a broken line inside the recording paper inlet portion 51 in a free state.

When the recording paper S enters the fixing device 50 through the recording paper inlet portion 51, the arm 31*a* tilts and rotates against an erecting force as shown by a solid line by contact with the recording paper S. As a result, the sensor 31 outputs an ON-signal and inputs the ON-signal into the control circuit portion 20. The control circuit portion 20 detects the presence of the recording paper S in the inlet portion 51 side of the fixing device 50 by the ON-signal inputted from the sensor 31. Further, the sensor 31 also detects a tilt angle of the arm 31*a* and inputs also information on the tilt angle into the control circuit portion 20. The arm 31*a* returns to the erected state indicated by the broken line when a rear end portion of the recording paper S entered the fixing device 50 is spaced from the arm 31*a*.

6) Exit-Side Sensor Unit F

This unit F is provided downstream of the unit B with respect to the recording paper feeding direction X, and includes a sensor 32 for detecting the recording paper S coming out of the fixing device 50 through a recording paper outlet portion 52. A sensor arm 32*a* of the sensor 32 is projected and erected as shown by a solid line inside the recording paper outlet portion 52 in a free state.

When the recording paper S comes out of the fixing device 50 through the recording paper outlet portion 52, the arm 32*a* tilts and rotates against an erecting force as shown by a broken line by contact with the recording paper S. As a result, the sensor 32 outputs an ON-signal and inputs the ON-signal into the control circuit portion 20. The control circuit portion 20 detects the presence of the recording paper S in the outlet portion 52 side of the fixing device 50 by the ON-signal inputted from the sensor 31. The arm 32*a* returns to the erected state indicated by the solid line when a rear end portion of the recording paper S coming out of the fixing device 50 is spaced from the arm 31*a*.

7) Fixing Sequence

A fixing sequence of the fixing device 50 is as follows. In a stand-by state of the image forming apparatus (printer) 100 (i.e., in a stand-by state of input of an image forming job), the unit B is held in the spaced position in which the unit B is lowered relative to the unit A by the spacing operation of the pressing and spacing mechanism 23. The driving mechanism 21 is turned off, and rotation of the fixing roller 2 and the pressing roller 7 is stopped. Each of the electric power supplying circuit 22 for the heater 11, the exciting circuit 24 for the coil 13 and the fan driving motor 37 is turned off.

The image forming job is inputted into the control circuit portion 20 from a host device 40 (FIG. 4) such as a microcomputer, an image reader, a facsimile, a network or the like. Then, the control circuit portion 20 causes the image forming apparatus 100 to execute a predetermined warm-up operation (pre-operation of image formation: pre-rotation operation) and then causes the image forming apparatus 100 to execute the above-described image forming operation.

With respect to the fixing device 50, as the warm-up operation, an operation such that the temperature rise of the fixing device 50 is made to place the fixing device 50 in a fixable state is executed. In this embodiment, in a state in which the unit B is kept in the spaced position, the driving mechanism 21, the electric power supplying circuit 22, and the exciting circuit 24 is turned on. The fan driving motor 37 is kept in the OFF state. As a result, the fixing roller 2 and the pressing roller 7 are rotationally driven, and also the fixing belt 1 and the pressing belt 6 are rotated.

Further, the fixing belt 1 is induction-heated by the unit C to be increased in temperature to a predetermined fixing temperature, thus being temperature-controlled. Further, the pressing roller 7 is heated by the heater 11 to be increased in temperature to a predetermined control temperature, thus being temperature-controlled. The fan driving motor is kept in the OFF state.

In the fixing device 50 in this embodiment, as a member relating to fixing in contact with the recording paper S, thin endless belts 1 and 6 are employed in a fixing side and a pressing side, respectively, so that a low thermal capacity at a portion required to be kept at a high temperature is achieved compared with a conventional member. As a result, the thin endless belts 1 and 6 contribute to shortening of the warm-up operation time.

By executing an image forming operation subsequently to the warm-up operation described above, the recording paper S on which the unfixed toner image is carried is fed and introduced from the secondary transfer nip T2 side to the fixing device 50. At a leading end portion of the recording paper S, the arm 31*a* of the sensor 31 is tilted and rotated, so that the ON-signal of the sensor 31 is inputted into the control circuit portion 20. The control circuit portion 20 causes the pressing and spacing mechanism 23 to perform the pressing operation on the basis of the ON-signal.

As a result, the unit B is raised relative to the unit A to be press-contacted to the unit A, so that the nip N is formed between the fixing belt 1 and the pressing belt 6. Further, the recording paper S is nipped and fed through the nip N, so that the unfixed toner image is thermally fixed as a fixed image on the surface of the recording paper S.

The recording paper S is guided, at the surface where the unfixed toner image is carried toward the fixing belt 1, by a recording paper feeding guide to be introduced into the nip N. Then, the unfixed toner image on the recording paper S is fed while being closely contacted to the outer peripheral surface of the fixing belt 1, so that heat is applied principally from the fixing belt 1 and pressure is applied at the nip N and thus the unfixed toner image is fixed on the surface of the recording paper S.

By the press-contact between the fixing roller 2 and the pressing roller 7 and the press-contact between the fixing pad 4 and the pressing pad 9, the nip N is formed between the fixing belt 1 and the pressing belt 6 so as to be wide with respect to the recording paper feeding direction. For that reason, a predetermined heat quantity can be supplied to the rotational speed S is a short time, thus contributing to speed-up of the image formation.

The rotational speed S nipped and fed through the nip N to be subjected to image fixing is separated from the surface of fixing belt 1 in the exit side of the nip N and then gradually comes out of the fixing device 50 through the recording paper outlet portion 52 while the arm 32*a* of the sensor 32 is tilted and rotated against the erecting force.

The pressing roller 7 is urged toward the fixing roller 2 by a predetermined urging force to deform a soft silicone rubber layer (elastic layer) 2*b* at the outer peripheral surface of the fixing roller 2, so that a nip outlet is formed where a separating property of the recording paper S from the fixing belt 1 is ensured.

That is, the fixing roller 2 inside the fixing belt 1 is the elastic roller having the silicone rubber layer 2*b*, and the pressing roller 7 inside the pressing belt 7 is the rigid roller formed of the iron alloy. For this reason, at the nip outlet between the fixing belt 1 and the pressing belt 6, the degree of deformation of the fixing roller 2 becomes large. As a result, the fixing belt 1 is largely waved and deformed, so that the toner image-carried recording paper S is curvature-separated from the surface of the fixing belt 1 by the stiffness of the recording paper S itself.

The recording paper S is fed from the secondary transfer nip T2 to the fixing device 50 during the execution of the image formation, but the recording paper feeding force at the nip of the fixing device 50 is very much larger than the recording paper feeding force at the nip T2. For this reason, when the recording paper S in a state in which the recording paper S is fed while ranging from the nip T2 to the nip N is pulled toward the fixing device 50, at the nip T2, the difference in speed is generated between the recording paper S and the belt 122 and the roller 221, so that the image slips.

For that reason, in this embodiment, the peripheral speed of the fixing belt 1 is made slightly slower than the recording paper feeding speed (the peripheral speed of the roller 211) at the nip T2. As a result, a loop in a predetermined amount is formed on the recording paper S between the nip T2 and the nip N. Specifically, when the sensor 31 of the unit E of the fixing device 50 detects the predetermined recording paper loop amount (predetermined tilt angle of the arm 31*a*), the control circuit portion 20 controls the driving mechanism 21 to control the formation of the loop (amount). That is, the rotational speeds of the fixing roller 2 and the pressing roller 7 are finely adjusted in a direction of being decreased or increased so that the loop amount is maintained within a predetermined range.

When a trailing end portion of the recording paper S introduced into the fixing device 50 passes through the arm 32*a* of the sensor 32, the arm 32*a* returns to the erected state indicated by the solid line, so that the sensor 31 is turned off. The control circuit portion 20 discriminates that the recording paper S successfully passes through the inside of the fixing device 50 by a change in state of the sensors such that the sensor 31 is changed from the OFF state to the ON state and thereafter the sensor 32 is turned on in a predetermined timer time, and then the sensors 31 and 32 are successively turned off in associated predetermined timer times. If this is not the case, the control circuit portion 20 discriminates that recording paper jam occurs and then stops the image forming apparatus due to an emergency.

When both of the sensors 31 and 32 are turned off, the control circuit portion 20 returns the unit B to the spaced position by causing the pressing and spacing mechanism 23 to perform the spacing operation. Then, in the case where the image forming job is image formation of only one sheet, the control circuit portion 20 turns off the driving mechanism 21, the electric power supplying circuit 22 and the exciting circuit 24 to hold the fixing device 50 in the stand-by state.

In the case where the image forming job is continuous image formation (continuous sheet passing), the control circuit portion 20 causes the pressing and spacing mechanism 23 to perform the pressing operation to execute the image fixing operation every time when the sensor 31 is turned on by tilting and rotation of the arm 31*a* of the sensor 31 at the leading end portion of a subsequent recording paper S. That is, the control circuit portion 20 holds the unit B in the spaced position at a sheet interval of the continuous sheet passing and then moves the unit B to the pressing position every time when the recording paper S is introduced into the fixing device 50.

Then, when the recording paper S as a final sheet passes through the fixing device 50 and the sensor 32 is turned off, the control circuit portion 20 returns the unit B to the spaced position by causing the pressing and spacing mechanism 23 to perform the spacing operation. Further, the control circuit portion 20 turns off the driving mechanism 21, the electric power supplying circuit 22 and the exciting circuit 24 to hold the fixing device 50 in the stand-by state.

Incidentally, in the case of an operation in a continuous sheet passing mode, it is also possible to employ a constitution of control such that the unit B is held in the pressing position until the final recording paper S completely passes through the fixing device 50.

<Control of Fan 16 of Fan Cooling Unit D>

In this embodiment, the feeding of sheets of the recording paper S having various large to small width sizes in the image forming apparatus 100 and the fixing device 50 is made by so-called center-line basis sheet passing (feeding) based on a width center (line). Further, in this embodiment, a maximum width size (maximum enable sheet passing width size or maximum width of sheet capable of being introduced) of the recording paper S usable in the image forming apparatus 100 is 13×19 inch (width: 330 mm).

A surface temperature distribution of the fixing tension roller 3 in the fixing device 50 with respect to the longitudinal direction (axial direction) is constituted so as to sag at end portions of the recording paper S in the case where the recording paper S of 13×19 inch as the maximum width size described above is passed through the fixing device 50 on a center (line) basis. For that reason, in the case where the recording paper S of 13×19 inch is subjected to continuous sheet passing, the non-sheet-passing portion temperature rise does not occur conspicuously. Accordingly, in the case where the maximum width-sized recording paper is subjected to fixing, cooling by the fan cooling unit D is not performed.

On the other hand, in the case where the recording paper (small-sized recording paper) S narrower in width than 13×19 inch is subjected to continuous sheet passing, the non-sheet-passing portion temperature rise can occur conspicuously. As a countermeasure thereof, in this embodiment, a heat uniformizing member, contacted to the inner peripheral surface of the fixing belt 1 along the longitudinal direction of the fixing belt 1, for uniformizing (alleviating) the temperature distribution (thermal distribution) along the width direction (longitudinal direction) of the fixing belt 1, i.e., a heat pipe is provided.

Further, the above-described fan cooling unit D as a fan cooling means for cooling the fixing belt 1 by blowing air to the fixing belt 1 in a cooling position set at a predetermined position with respect to the longitudinal direction of the fixing belt 1 is provided. A position of a fan opening 19 of the fan cooling unit D is the cooling position set at the predetermined position with respect to the longitudinal direction of the fixing belt 1. Further, a change in air flow rate of the fan cooling unit D is made depending on the distance between the cooling position and an end portion position of a sheet passing region width of the recording paper S introduced into the fixing device 50.

Figure 5:
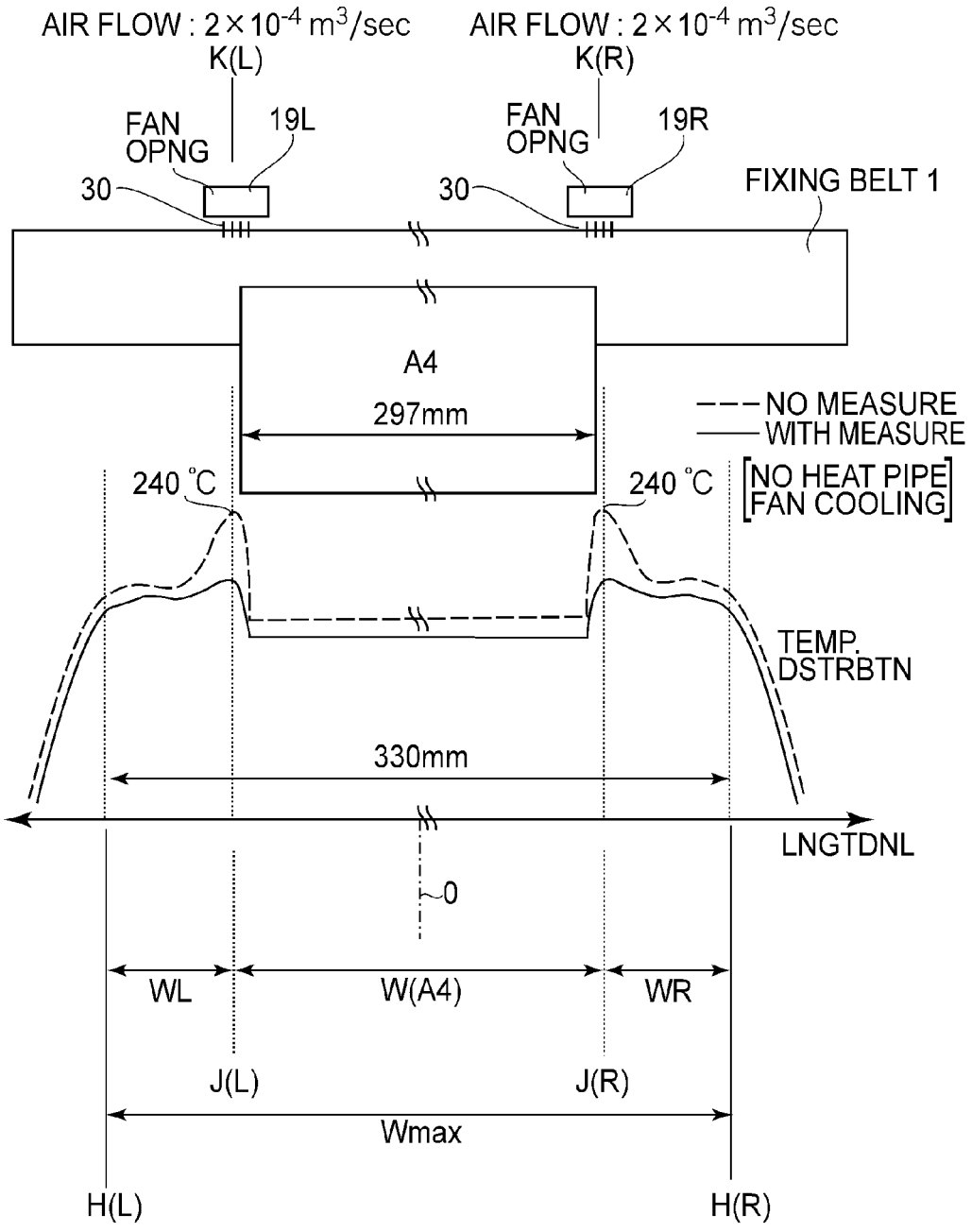
FIG. 5 is an illustration of a temperature distribution of a fixing device in Comparison Example 1 with respect to a longitudinal direction when sheets of A4-sized recording paper are continuously passed through the fixing device.

FIG. 5 is a schematic view for illustrating a relationship among the sheet passing region width (sheet passing portion), the end portion position, the cooling position, non-sheet-passing region width (non-sheet-passing portion), the non-sheet-passing portion temperature rise, and the like with respect to the fixing belt longitudinal direction of the fixing device 50 in this embodiment.

In FIG. 5, O represents a center (line) basis sheet passing line (phantom line), and Wmax represents the sheet passing region width (330 mm) of the large-sized recording paper (having the size of 13×19 inch in this embodiment) as the maximum width recording paper capable of being passed through the fixing device 50. Further, WL and WR are a non-sheet-passing region width [(Wmax−W(A4))/2] generated outside left and right ends, respectively, of a sheet passing region width W(A4).

In this embodiment, with respect to the longitudinal direction of the fixing belt 1, positions corresponding to left and right end portion positions J(L) and J(R) of the sheet passing region W(A4) of the A4-sized recording paper are set as cooling positions K(L) and K(R), respectively. Further, the fan cooling unit D is provided with left and right (two) fan openings 19L and 19R in the cooling positions K(L) and K(R), respectively. In this embodiment, each of the left and right fan openings 19L and 19R is 10 mm in width and 5 mm in height and is capable of blowing (sending) cooling air 30 to the fixing belt 1 in the cooling position (K(L) or K(R)).

In the following, in order to clarify an effect of the present invention, the effect of the present invention will be described in comparison with Comparison Examples 1 and 2.

Comparison Example 1

First, as Comparison Example 1, the case where there is no heat pipe 5 inside the fixing tension roller 3, i.e., the case where there is no heat uniformizing member at inner and outer peripheral surfaces of the fixing belt 1 will be described.

In the case where the A4-sized recording paper S as the small-sized recording paper is subjected to the continuous sheet passing, by generating the air flow rate of $2\times10^{-4}$ $m^3$/sec by the fan cooling unit D, as shown in the temperature distribution indicated by a solid line in FIG. 5, the non-sheet-passing portion temperature rise can be alleviated. A broken line represents the temperature distribution in the case where no countermeasure is taken, i.e., in the case where both of heat uniformization by the position and fan cooling are not performed. In this case, the non-sheet-passing portion temperature rise reaches 240° C.

However, in the case where there is no heat uniformizing member even when the fan cooling is performed, a cooling effect by the fan cooling unit D in which the fan openings 19L and 19R are positioned at widthwise end portions of the A4-sized recording paper is, as shown by the temperature distribution indicated by the solid line in FIG. 5, such that the cooling effect is limited to the widthwise end portions of the A4-sized recording paper but cannot be extended to a wide range.

Figure 6:
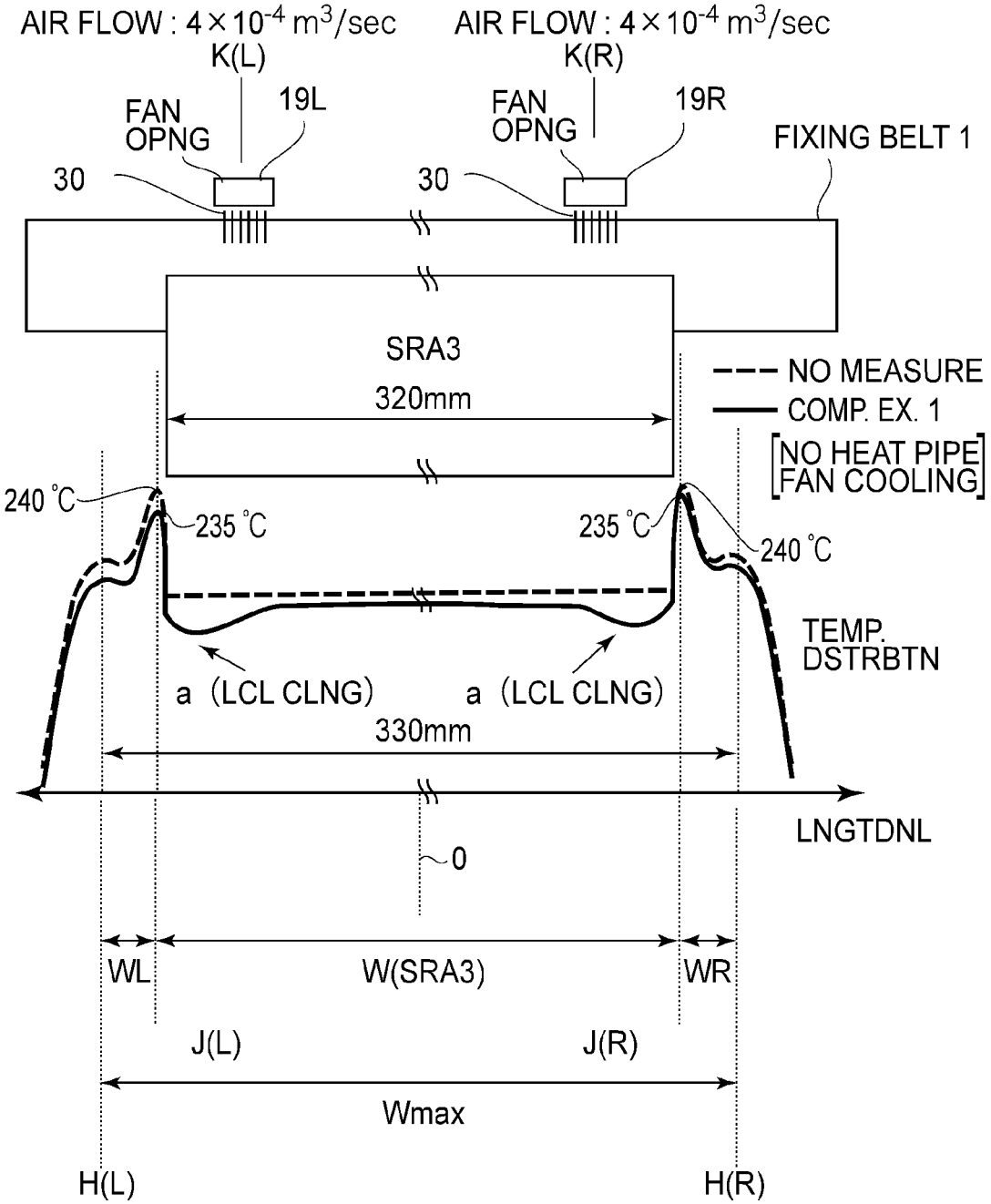
FIGS. 6 and 7 are illustrations of fixing devices in Comparison Examples 1 and 2, respectively, with respect to the longitudinal direction when sheets of SRA3-sized recording paper are continuously passed through the fixing devices.

For that reason, even in the case of the small-sized recording paper, in the case where recording paper S, such as SRA3-sized recording paper S, larger in width than the A4-sized recording paper S is subjected to continuous sheet passing, as shown in FIG. 6, a region where the non-sheet-passing portion temperature rise is generated is different in position from the fan openings 19L and 19R of the fan cooling unit D. For that reason, there is no effect with respect to the non-sheet-passing portion temperature rise in a region of each of the widthwise end portions of the SRA3-sized recording paper S. Specifically, in the case of no countermeasure (indicated by the broken line, i.e., no heat pipe and no fan cooling), as indicated by the broken line in FIG. 6, the non-sheet-passing portion temperature rise cannot be negligible (i.e., reaches 240° C.).

As a countermeasure thereof, similarly as in the case of the A4-sized recording paper (FIG. 5), in the case where the fan cooling unit D is used, as shown in FIG. 6, even when the air flow rate is increased to $4\times10^{-4}$ $m^3$/sec in order to enhance the cooling effect in the non-sheet-passing region remote from the fan opening 19, widthwise end portion regions a of the A4-sized recording paper are locally cooled to yield a harmful effect. In this case, the non-sheet-passing portion temperature rise with respect to each of the widthwise end portions of the SRA3-sized recording paper is merely alleviated to 235° C., so that not only the effect of the countermeasure is small but also local improper fixing and uneven glossiness are generated.

Comparison Example 2

Next, as Comparison Example 2, the case where although the heat pipe 5 is provided inside the fixing tension roller 3 as in Comparison Example 1 but the air flow rate of the fan cooling unit D is not changed depending on the recording paper size, i.e., the air flow rate is constant will be described.

In the case where the A4-sized recording paper is subjected to the continuous sheet passing, similarly as in Comparison Example 1, the non-sheet-passing portion temperature rise can be alleviated by generating the air flow rate of $2\times10^{-4}$ $m^3$/sec.

Further, also in the case where the SRA3-sized recording paper is subjected to the continuous sheet passing, similarly as in the case of the A4-sized recording paper, the air is blown to the widthwise end portion regions of the A4-sized recording paper at the air flow rate of $2\times10^{-4}$ $m^3$/sec. As a result, the cooling effect on the widthwise end portion regions of the A4-sized recording paper to which the cooling air 30 is directly blown can be indirectly exercised on the widthwise end portion regions of the SRA3-sized recording paper by the heat pipe 5.

Figure 7:
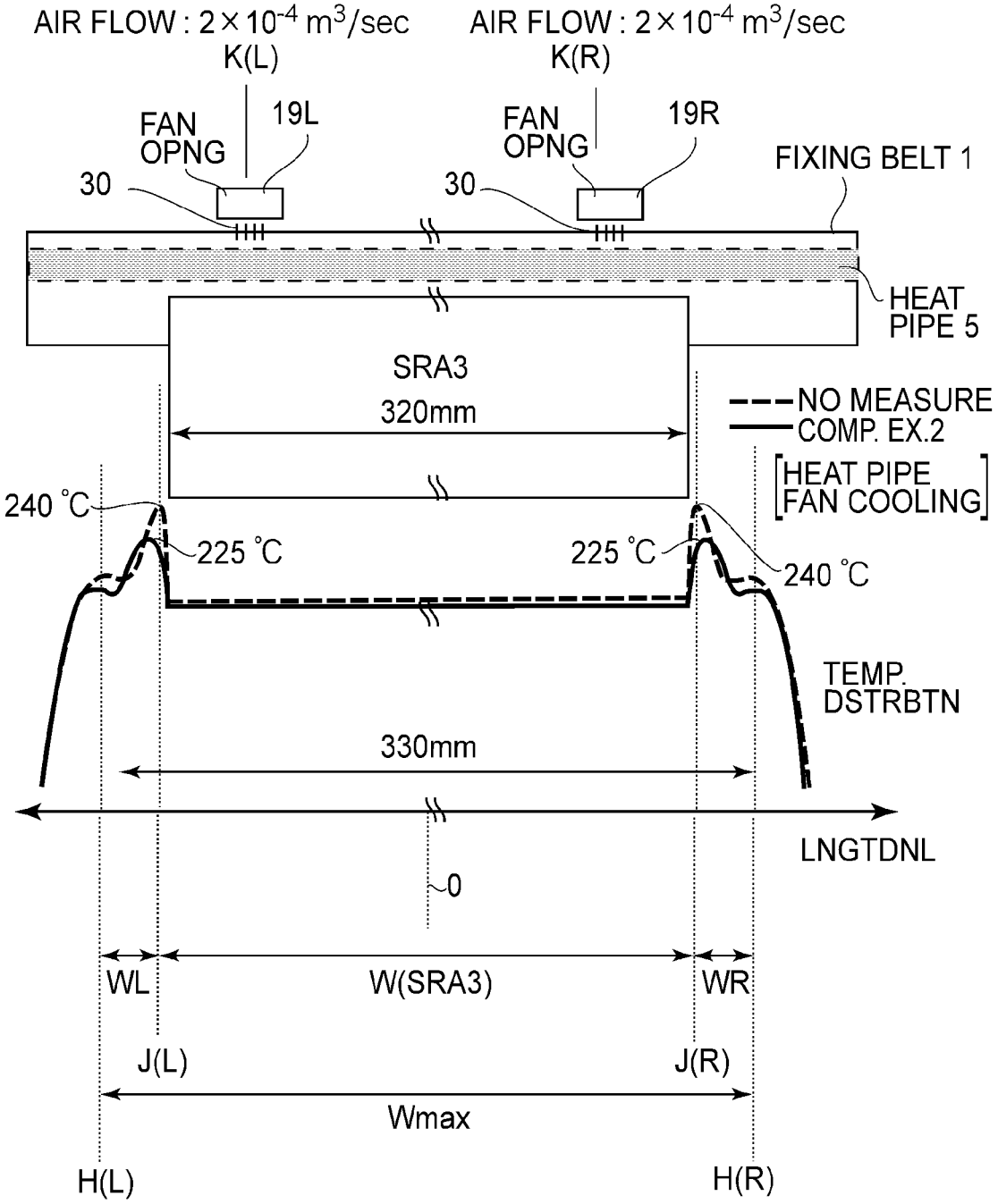

For that reason, as shown in FIG. 7, the non-sheet-passing portion temperature rise of the SRA3-sized recording paper can be alleviated to 225° C. Further, by the heat pipe 5, it is possible to prevent local cooling of the A4-sized recording paper with respect to the widthwise end portion regions.

However, compared with the cooling effect on the widthwise end portion regions of the A4-sized recording paper in which the cooling air 30 is directly blown, the cooling effect on the widthwise end portion regions of the SRA3-sized recording paper is small, so that the countermeasure against the non-sheet-passing portion temperature rise becomes insufficient.

[Verification Result in the Case where Constitution in This Embodiment is Employed]

In this embodiment, as described above, as the heat uniformizing member, the heat pipe 5 is used and provided inside the fixing tension roller 3 in contact with the fixing tension roller 3. Further, the air flow rate of the fan cooling unit (fan cooling means) D is changed depending on a distance Y (with respect to the longitudinal direction of the fixing belt 1) between the cooling position K set at the predetermined position with respect to the longitudinal direction of the fixing belt 1 and the end portion position J of the sheet passing region width of the recording paper S introduced into the fixing device 50. That is, by switching the cooling air flow rate depending on the widthwise of the rotational speed S, compared with Comparison Examples 1 and 2, with respect to the recording papers having various width sizes, it is possible to meet the non-sheet-passing portion temperature rise.

Table 1 shows effects of Comparison Examples 1 and 2 and Embodiment 1 with respect to the non-sheet-passing portion temperature rise in the case where the SRA3-sized recording paper is subjected to continuous sheet passing.

TABLE 1

| | HUN*1 | AFR*2 ($m^3$/sec) | NSPPTR*3 |
|---|---|---|---|
| NO MEASURE | YES | 0 | 240° C. |
| EMB. 1 | YES | $4 \times 10^{-4}$ | 200° C. |
| COMP. EX. 1 | NO | $4 \times 10^{-4}$ | 235° C. |
| COMP. EX. 2 | YES | $2 \times 10^{-4}$ | 225° C. |

*1"HUM" is the heat uniformizing member.
*2"AFR is the air flow rate ($m^3$/sec).
*3"NSPPTR" is the temperature (° C.) of the non-sheet-passing portion temperature rise.

Figure 8:
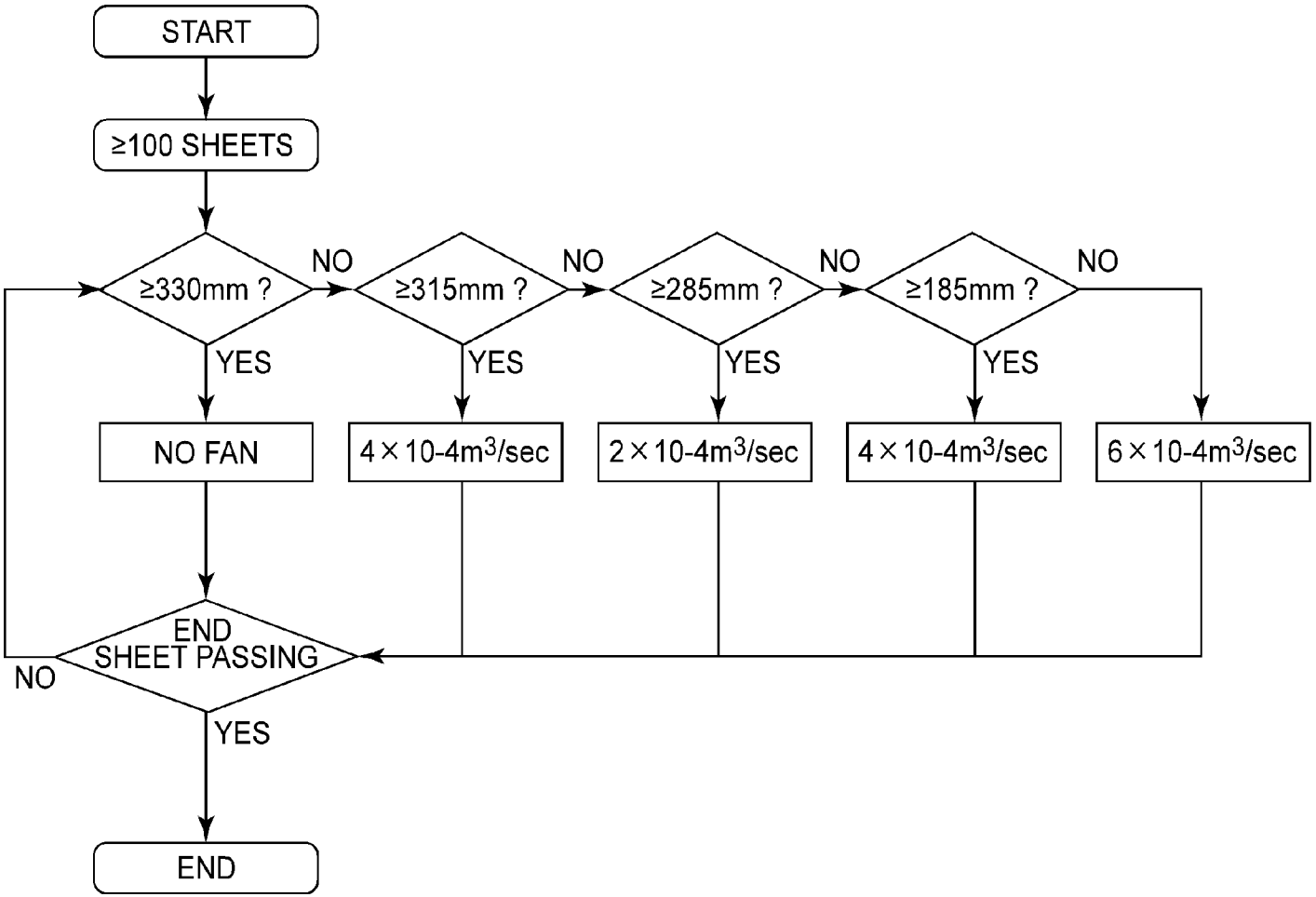
FIG. 8 is a flow chart of air flow rate control of a fan in Embodiment 1.

In the following, a description will be provided specifically. With respect to the recording papers S having the various width sizes, the control circuit portion (controller) 20 controls turning on/off and the air flow rate of the fan cooling unit D in accordance of a flow chart (control program) of FIG. 8. That is, the air flow rate of the fan cooling unit (fan cooling means) D is increased with a longer distance Y between the cooling position K set at the predetermined position with respect to the longitudinal direction of the fixing belt 1 and the end portion position J of the sheet passing region width of the recording paper S introduced into the fixing device 50.

In this embodiment, the cooling position K is, as described above, set at the position corresponding to each of the left and right end portions J(L) and J(R) of the sheet passing region width W(A4) of the A4-sized recording paper with respect to the longitudinal direction of the fixing belt 1.

Figure 4:
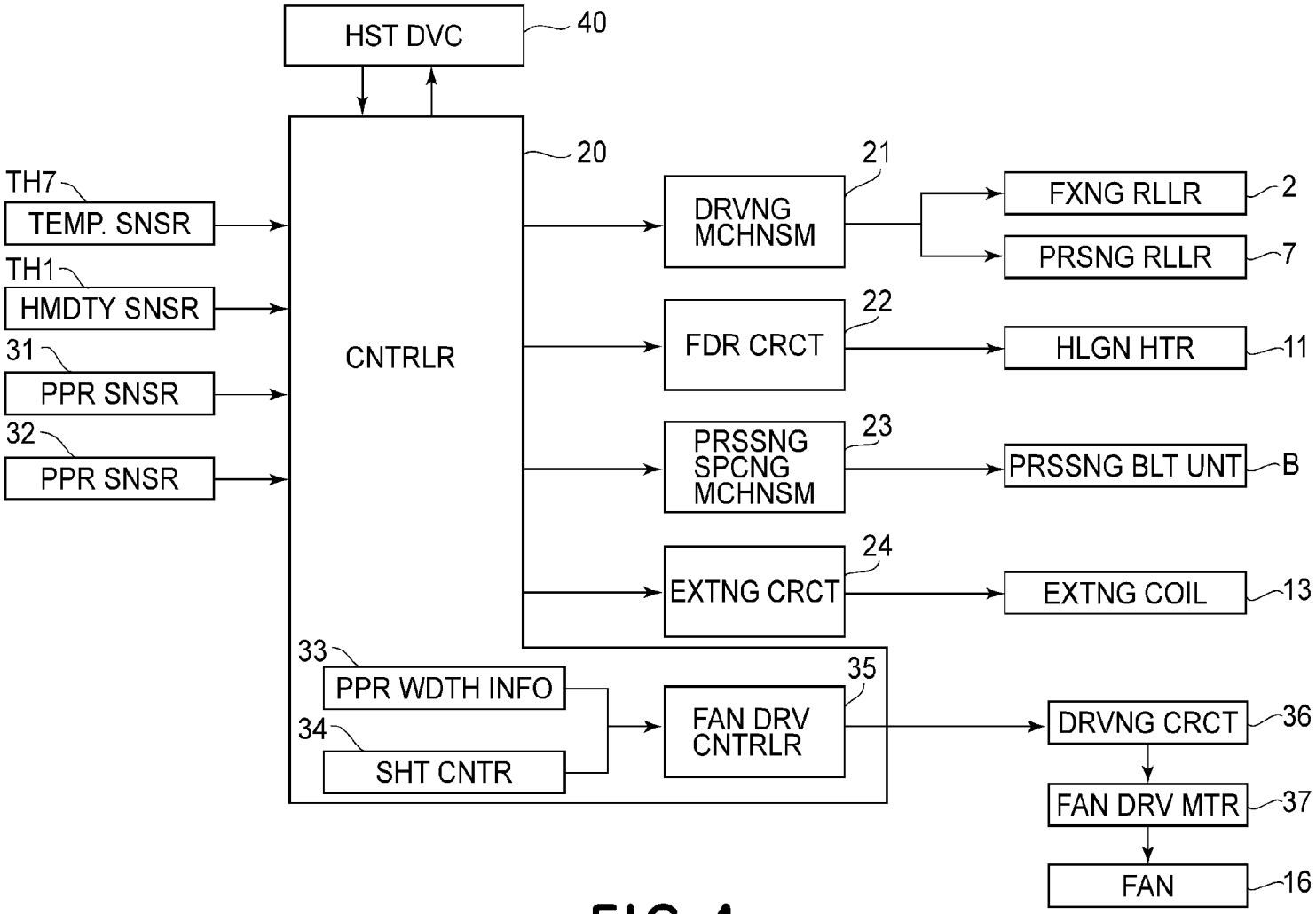
FIG. 4 is a block diagram of a control system of the fixing device.

Further, in this embodiment, during a job in which a plurality of sheets of the recording paper are continuously subjected to image formation in accordance with a single image formation instruction, the number of the sheets of the recording paper subjected to the image formation is counted by a counter 34 (FIG. 4). Further, at the time when the number of the sheets counted by the counter 34 exceeds 100 sheets, the control circuit portion 20 transmits recording paper width information 33 of the recording paper passed through the fixing device 50 to the fan drive control portion 35 and then determines the air flow rate of the fan while actuating the fan in accordance with the flow chart of FIG. 8. The determined air flow rate of the fan is executed by the driving motor 37 via the driving circuit 36.

Here, in the fixing device 50 in this embodiment, even in the case where the recording paper passed through the fixing device 50 in the small-sized recording paper, when the number of the passed sheets is less than 100 sheets, the non-sheet-passing portion temperature rise is suppressed by the presence of the heat uniformizing member, and therefore the fan is not actuated. The fan is actuated when the number of the sheets is 100 sheets or more. In the case where the passed portion is the recording paper having the maximum sheet passing width, noticeable non-sheet-passing portion temperature rise is not generated, and therefore the fan is not actuated not only in the case where the number of the sheets is less than 100 sheets but also in the case where the number of the sheets is 100 sheets or more.

The recording paper width information 33 is inputted from the host device 40 or an operating portion (not shown) of the image forming apparatus 100. Alternatively, the information 33 is inputted from a paper width detecting means (not shown) for detecting the width of the recording paper passed through the fixing device 50. The count of the counter 34 is reset when the continuous sheet passing is ended.

Figure 9:
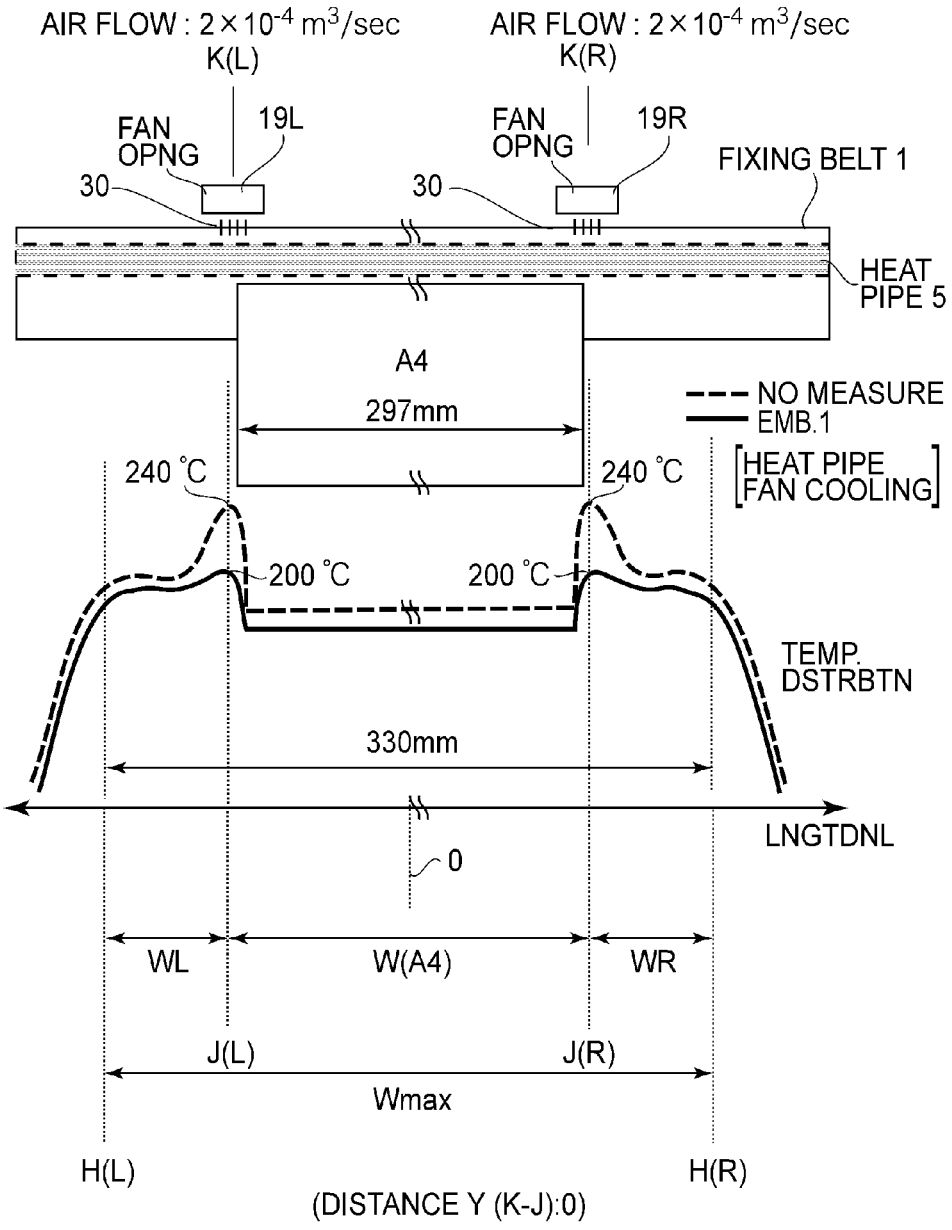
FIG. 9 is an illustration of a temperature distribution of a fixing device in Embodiment 1 with respect to a longitudinal direction when sheets of A4-sized recording paper are continuously passed through the fixing device.

1) For example, in the case where the A4-sized recording paper is subjected to the continuous sheet passing (exceeding 100 sheets), in this embodiment, the cool position K and the end portion position J of the sheet passing region width W(A4) of the introduced recording paper S coincide with each other, so that the distance Y between the positions K and J is zero. In this case, as shown in FIG. 9, similarly as in Comparison Examples 1 and 2, by generating the air flow rate of $2\times10^{-4}$ $m^3$/sec, the non-sheet-passing portion temperature rise can be alleviated.

2) In the case where the SRA3-sized recording paper is subjected to the continuous sheet passing (exceeding 100 sheets), in this embodiment, the distance Y between the cooling position K and the end portion position J of the sheet passing width W (SRA3) of the introduced recording paper S is 16.5 mm. In this case, the air flow rate is increased so that the cooling effect capable of sufficiently alleviating the non-sheet-passing portion temperature rise when the predetermined width size is the SRA3 size is exercised by the heat pipe 5 on a portion ranging from the widthwise end portion regions of the A4-sized recording paper, to which the cooling air 30 is directly blown, to the widthwise end portion regions of the SRA3-sized recording paper.

Figure 10:
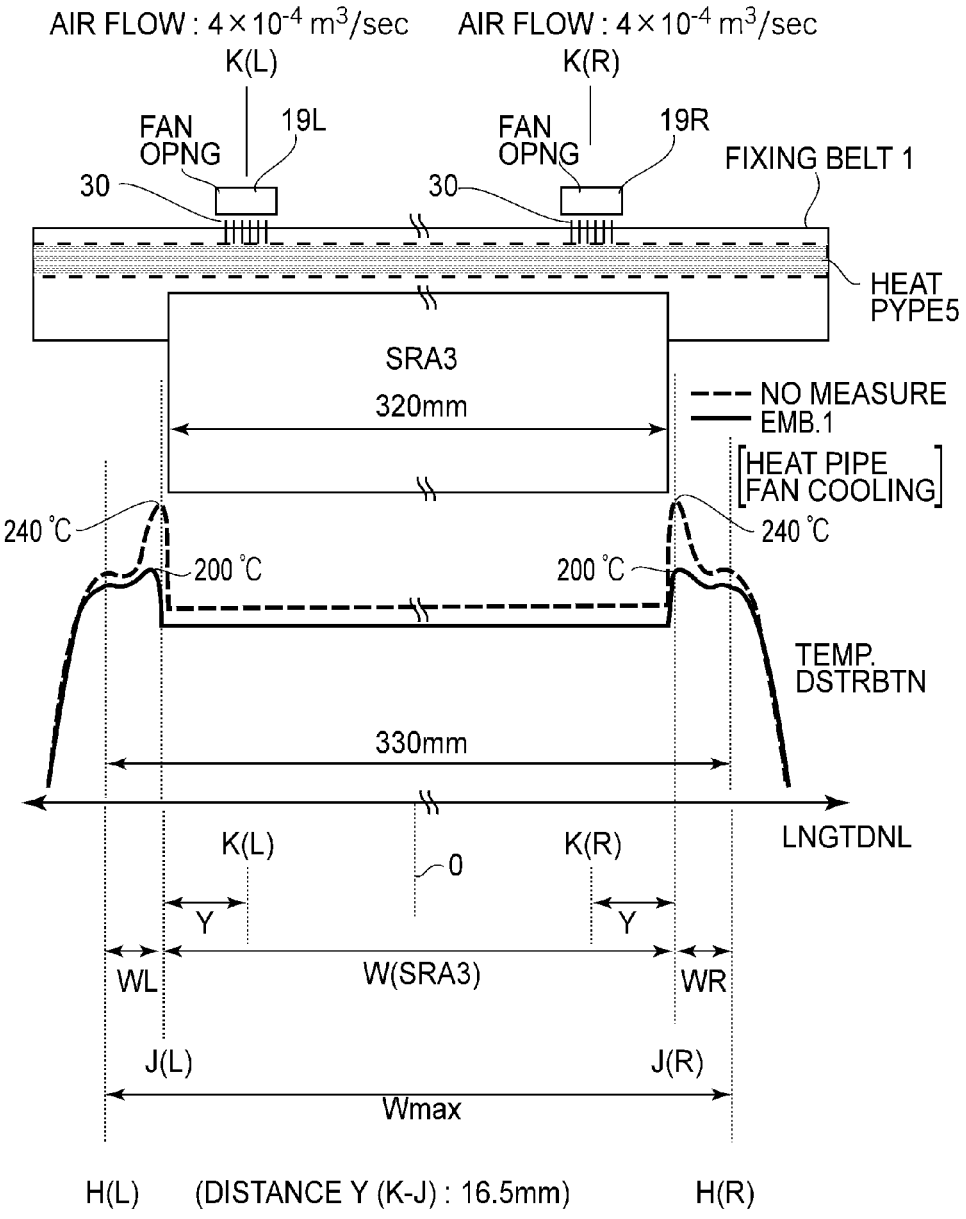
FIG. 10 is an illustration of a temperature distribution of the fixing device in Embodiment 1 with respect to the longitudinal direction when sheets of SRA3-sized recording paper are continuously passed through the fixing device.

In this embodiment, the air flow rate is increased up to $4\times10^{-4}$ $m^3$/sec. As a result, as shown in FIG. 10, the non-sheet-passing portion temperature rise when the width size is the SRA3 size can be alleviated to 200° C.

3) In the case where the A4-sized recording paper S is subjected to the continuous sheet passing (exceeding 100 sheets) by short edge feeding (width: 210 mm), the distance Y between the positions K and J is 43.5 mm. In this case, the non-sheet-passing portion temperature rise can be alleviated with reliability of further increasing the air flow rate to $6\times10^{-4}$ $m^3$/sec so as to exercise the sufficient cooling effect on the recording paper end portion regions remote from the fan openings 19L and 19R.

4) In the case where the width size is the SRA3 size, the sheet passing region is cooled and therefore there is a fear that the temperature of the fixing belt 1 is locally lowered, but by the effect of the heat pipe 5, the portion cooled by the fan is expanded during one full turn of the fixing roller 1. For that reason, uneven glossiness and improper fixing are not generated in the sheet passing portion end positions of the A4-sized recording paper.

The air blowing of the fan 16 is stopped when the continuous sheet passing exceeding 100 sheets is ended. Incidentally, in this embodiment, the air flow rate of the fan 16 is adjusted by changing a rotational speed of the fan 16. In the case where the air flow rate of the fan 16 is increased, the rotational speed of the fan 16 is increased, and in the case where the air flow rate is lowered, the rotational speed of the fan 16 is lowered.

Further, in this embodiment, the constitution in which the fan 16 sends the air to the fixing belt 1 is employed, but it is also possible to employ a constitution in which the fan sends the air to the pressing belt.

In this embodiment, the cooling position K is set at each of positions corresponding to the left and right end portion positions J(L) and J(R) of the sheet passing region width (A4) of the A4-sized recording paper with respect to the width direction of the fixing belt 1, but is not limited thereto. The cooling position K can be set at a position which corresponds to the non-sheet-passing portion of the minimum width recording paper capable of being passed through (introduced into) the fixing device 50 and which corresponds to the sheet passing portion of the maximum width recording paper capable of being passed through (introduced into) the fixing device 50.

Embodiment 2

Next, Embodiment 2 will be described. Incidentally, constituent members (portions) having the same functions as those in Embodiment 1 are represented by the same reference numerals or symbols and will be omitted from detailed description.

Figure 12:
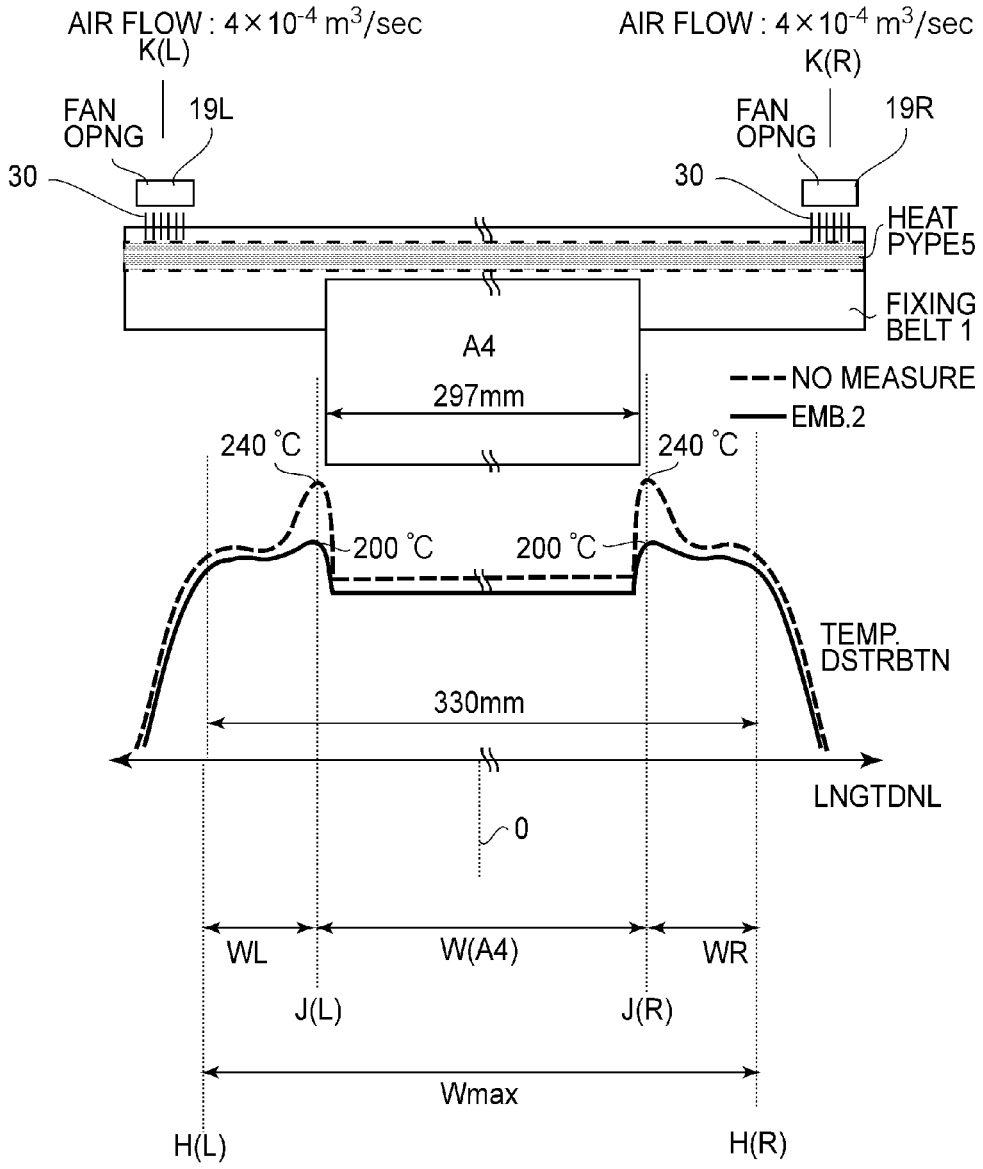
FIG. 12 is an illustration of a temperature distribution of a fixing device in Embodiment 2 with respect to a longitudinal direction when sheets of A4-sized recording paper are continuously passed through the fixing device.
Figure 13:
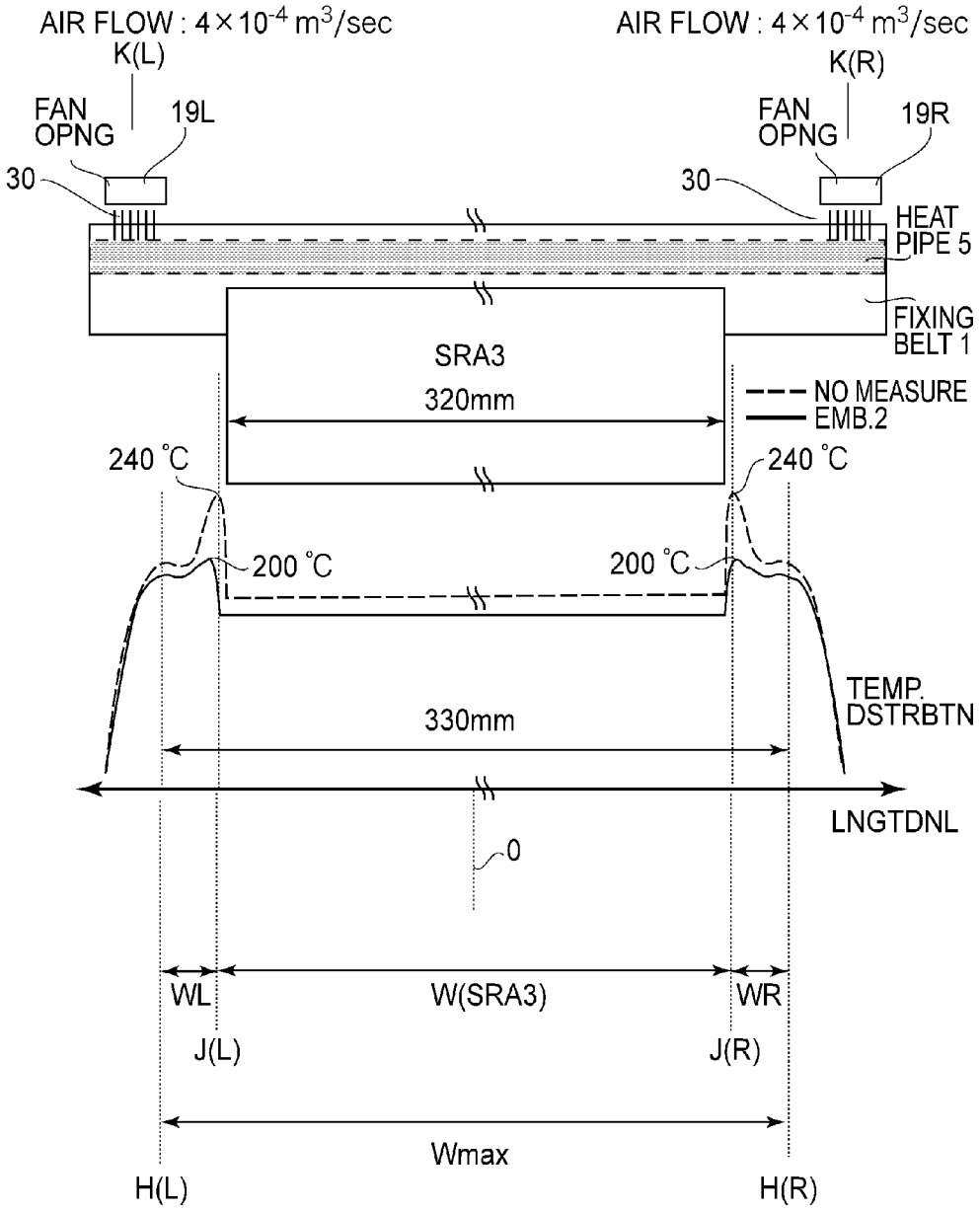
FIG. 13 is an illustration of a temperature distribution of the fixing device in Embodiment 1 with respect to the longitudinal direction when sheets of SRA3-sized recording paper are continuously passed through the fixing device.

In this embodiment, the cooling position K is different from that in Embodiment 1. That is, as shown in FIGS. 12 and 13, the case where the cooling position K is each of positions outside the end portion positions, with respect to the width direction, of the sheet passing region width of the maximum width recording paper capable of being passed through the fixing device 50 will be described.

Specifically, the case where each of the fan openings 19L and 19R of the fan cooling unit D is positioned outside the maximum sheet passing width region Wmax of the recording paper of 13×19 inch (width: 330 mm) as the maximum recording paper will be described.

Constitutions other than the positions of the fan openings 19L and 19R and air flow rate control of the fan cooling unit D are the same as those in Embodiment 1.

<Position of Fan Openings 19L and 19R and Air Flow Rate Control>

When the width size of the recording paper S subjected to continuous sheet passing is a smaller size, the air flow rate generated by the fan cooling unit D is made larger. That is, the air flow rate generated by the fan cooling unit D is made larger with a longer distance from each of the fan openings 19L and 19R (cooling positions K(L) and K(R)) of the fan cooling unit D to the position where the non-sheet-passing portion temperature rise occurs.

Figure 11:
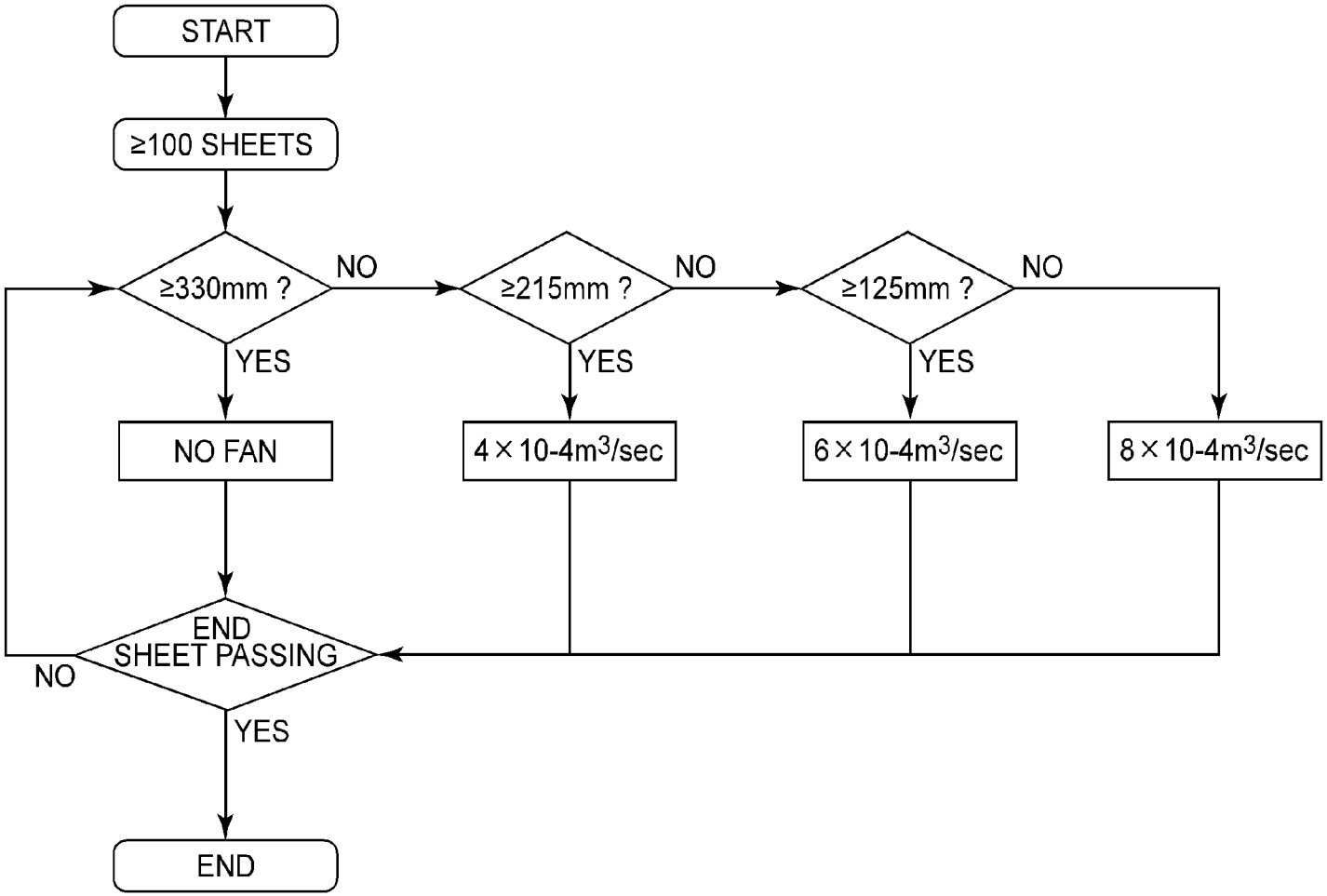
FIG. 11 is a flow chart of air flow rate control of a fan in Embodiment 2.

Specifically, with respect to the various width sizes of the recording paper S, the air flow rate of the fan is changed in accordance with a flow chart of FIG. 11.

Here, in the case of the fixing device 50 in this embodiment, even in the case where the recording paper passed through the fixing device 50 in the small-sized recording paper, when the number of the passed sheets is less than 100 sheets, the non-sheet-passing portion temperature rise is suppressed by the presence of the heat uniformizing member, and therefore the fan is not actuated. The fan is actuated when the number of the sheets is 100 sheets or more. In the case where the passed portion is the recording paper having the maximum sheet passing width, non-sheet-passing portion temperature rise is not generated, and therefore the fan is not actuated not only in the case where the number of the sheets is less than 100 sheets but also in the case where the number of the sheets is 100 sheets or more.

In the case where the passed recording paper is the small-sized recording paper and the number of the passed sheets exceeds 100 sheets, e.g., with respect to the recording papers of SRA3 and A4 in width size, by setting the air flow rate at $4\times10^{-4}$ $m^3$/sec, the non-sheet-passing portion temperature rise can be suppressed to 200° C. as shown in FIGS. 12 and 13.

With respect to the case of short edge feeding of the A4-sized recording paper having a further narrower width, by setting the air flow rate at $6\times10^{-4}$ $m^3$/sec, even in the case where a paper end portion is spaced from the fan openings 19L and 19R, the non-sheet-passing portion temperature rise can be suppressed to 200° C.

In this way, by changing the air flow rate depending on the paper width size, even in the case where the non-sheet-passing portion temperature rise region is spaced from the fan openings 19L and 19R (cooling positions K(L) and K(R)), the sufficient cooling effect can be exercised on the non-sheet-passing portion temperature rise region. That is, prevention of the non-sheet-passing portion temperature rise depending on the paper width size can be realized by a simple constitution.

Further, in this embodiment, the constitution in which the fan 16 sends the air to the fixing belt 1 is employed, but it is also possible to employ a constitution in which the fan sends the air to the pressing belt.

Other Embodiments

1) The image heating apparatus according to the present invention is not limited to use as the fixing device as in Embodiments 1 and 2. The image heating apparatus is also effective as an image modifying apparatus for modifying glossiness or the like of an image which is once fixed or partly fixed on a recording material (recording paper).

2) The constitution of the image heating apparatus according to the present invention is not limited to the twin belt constitution as in Embodiments 1 and 2, but may also be an apparatus constitution in which an opposing member in a roller.

The opposing member for forming the nip in combination with the rotatable heating member is not limited to the rotatable member. That is, in the case where the rotatable heating member is directly driven by the driving means, the opposing member may also be not the rotatable member but can also be a non-rotatable member such as a pad or a plate-like member having small friction coefficient at a surface as a contact surface with the rotatable heating member or the recording material.

The heat uniformizing member for uniformizing the temperature distribution of the rotatable heating member with respect to the longitudinal direction can also be constituted as a device to be contacted to an outer peripheral portion of the rotatable heating member. Further, the heat uniformizing member can also be constituted as a device provided at each of inner and outer peripheral portions of the rotatable heating member. The heat uniformizing member is not limited to the rotatable member but may also be a non-rotatable member such as a plate-like member or a block member.

The heating mechanism for heating the rotatable heating member or the opposing member is not limited to the electromagnetic induction heating member. It is also possible to use other known heating mechanisms of an internal or external heating type, such as a halogen lamp, an infrared lamp and a ceramic heater.

3) The recording material introduction type of the image heating apparatus is not limited to the center (line) basis feeding of the fixing device in Embodiments 1 and 2, but may also be one-side basis feeding. Also with respect to the one-side basis feeding is similar to the center basis feeding. That is, also with respect to this image heating apparatus, such a technique that in the case where the fan opening position is fixed, the air flow rate of the fan cooling means is increased with a longer distance from the fan opening position to the non-sheet-passing portion temperature rise position of the recording material passing region width thereby to exercise the cooling effect on the non-sheet-passing portion temperature rise position is included.

4) The fixing device in the present invention may also be carried out in an image forming apparatus, other than the color electrophotographic printer as in Embodiments 1 and 2, such as a monochromatic copying machine, a facsimile, a monochromatic printer or a multi-function machine of these machines. That is, the fixing device and the color electrophotographic printer in Embodiments 1 and 2 are not limited to combinations of the above-described constituent members but may also be realized in other embodiments in which a part or all thereof are replaced with their alternative members.

5) The image forming type of the image forming apparatus is not limited to the electrophotographic type but may also be an electrostatic recording type or a magnetic recording type. Further, the image forming type is not limited to the transfer type but may also be a type in which the image is formed on the recording material by a direct type.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 008243/2013 filed Jan. 21, 2013, which is hereby incorporated by reference.

What is claimed is:

1. An image heating apparatus comprising:

an endless belt configured to heat an image on a sheet;

a heating mechanism configured to heat said endless belt;

a fan configured to blow air toward a predetermined region of said endless belt, wherein the predetermined region is positioned in an end portion side of said apparatus, with respect to a widthwise direction of said endless belt, outside a region where first sheets narrower than maximum width sheets usable in said image heating apparatus are contactable to said endless belt, and is in an overlapping positional relationship with a region where second sheets narrower than the maximum width sheets and broader than the first sheets, are contactable to said endless belt;

a controller configured to operate said fan to cool said endless belt, wherein said controller turns on blowing of the air by said fan when said endless belt is cooled during heating of the image on the first sheets, and turns off the blowing of the air by said fan during heating of the image on the maximum width sheets; and a heat pipe configured to move heat in a direction of uniformizing a temperature distribution of said endless belt with respect to a widthwise direction of said endless belt, wherein said heat pipe contacts said endless belt in a region broader than the region where the second sheets are contactable to said endless belt with respect to the widthwise direction of said endless belt;

wherein said controller turns on the blowing of the air by said fan when said endless belt is cooled during the heating of the image on the second sheets.

2. An image heating apparatus according to claim 1, wherein said controller operates said fan at a first rotational speed when said endless belt is cooled during the heating of the image on the first sheets, and operates said fan at a second rotational speed higher than the first rotational speed when said endless belt is cooled during the heating of the image on the second sheets.

3. An image heating apparatus according to claim 1, further comprising a rotatable member configured to form a nip, for heating the image on the sheets, in cooperation with said endless belt, wherein a position where said endless belt is cooled by said fan is upstream of a position where said heat pipe contacts said endless belt with respect to a rotational direction of said endless belt on the basis of the nip.

4. An image heating apparatus according to claim 1, further comprising a counter configured to count the number of the first sheets continuously subjected to the heating of the image, wherein said controller operates said fan to cool said endless belt when the number of the first sheets counted by said counter reaches a predetermined number of sheets.

5. An image heating apparatus according to claim 1, further comprising a counter configured to count the number of second sheets continuously subjected to the heating of the image, wherein said controller operates said fan to cool said endless belt when the number of the second sheets counted by said counter reaches a predetermined number of sheets.

6. An image heating apparatus according to claim 1, wherein said heating mechanism includes an exciting coil configured to generate magnetic flux for heating said endless belt through electromagnetic induction heating.

7. An image heating apparatus according to claim 1, further comprising a second fan which is positioned in another end portion side of said apparatus, with respect to the widthwise direction of said endless belt, outside the region where the first sheets are contactable to said endless belt and which is positioned opposite from said fan with respect to the widthwise direction of said endless belt.

* * * * *